US011465008B2

(12) United States Patent
Draper

(10) Patent No.: US 11,465,008 B2
(45) Date of Patent: Oct. 11, 2022

(54) FITNESS MACHINE WITH ARC PLATES

(71) Applicant: Bradley Draper, Herriman, UT (US)

(72) Inventor: Bradley Draper, Herriman, UT (US)

( * ) Notice: Subject to any disclaimer, the term of this patent is extended or adjusted under 35 U.S.C. 154(b) by 50 days.

(21) Appl. No.: 17/166,971

(22) Filed: Feb. 3, 2021

(65) Prior Publication Data

US 2021/0291006 A1 Sep. 23, 2021

Related U.S. Application Data

(60) Provisional application No. 63/091,591, filed on Oct. 14, 2020, provisional application No. 62/991,949, filed on Mar. 19, 2020.

(51) Int. Cl.

| | |
|---|---|
| ***A63B 21/04*** | (2006.01) |
| ***A63B 21/00*** | (2006.01) |
| ***A63B 21/062*** | (2006.01) |
| ***A63B 21/055*** | (2006.01) |
| ***A63B 22/00*** | (2006.01) |
| ***A63B 21/06*** | (2006.01) |
| ***A63B 21/16*** | (2006.01) |

(52) U.S. Cl.

CPC ..... *A63B 21/0428* (2013.01); *A63B 21/0552* (2013.01); *A63B 21/063* (2015.10); *A63B 21/0604* (2013.01); *A63B 21/154* (2013.01); *A63B 21/169* (2015.10); *A63B 2022/0079* (2013.01)

(58) Field of Classification Search

CPC ..... A63B 21/00058; A63B 21/00061; A63B 21/00065; A63B 21/02; A63B 21/028; A63B 21/04; A63B 21/0407; A63B 21/0428; A63B 21/0442; A63B 21/055–0557; A63B 21/062; A63B 21/0626; A63B 21/0628; A63B 21/063; A63B 21/15; A63B 21/151; A63B 21/154; A63B 21/156; A63B 21/169; A63B 21/4045; A63B 21/0604; A63B 21/0414; A63B 21/4043; A63B 2022/0079

See application file for complete search history.

(56) References Cited

U.S. PATENT DOCUMENTS 4,600,196 A * 7/1986 Jones ..... A63B 21/155 482/130

4,747,594 A * 5/1988 Houde ..... A63B 21/1681 482/904

(Continued)

*Primary Examiner* — Garrett K Atkinson
*Assistant Examiner* — Kathleen M Fisk
(74) *Attorney, Agent, or Firm* — Workman Nydegger

(57) ABSTRACT

Improved designs for exercise machines that facilitate muscle development and other therapeutics are disclosed. The machine includes a frame, a pulley assembly, and cable extending through the pulley assembly. The cable has attachments, including an attachment for connecting to a pull handle. The cable is also connected to a selectively variable moveable resistance unit. This unit is structured to provide an elastic resistance when a pulling force is applied to the pull handle. The unit is connected to the cable and includes an elastomeric body that provides the elastic resistance and also includes an arc plate that provides a curved support member on which a portion of the elastomeric body at least partially wraps around. Movement of the arc plate causes the elastomeric body to stretch and to provide the elastic resistance.

9 Claims, 29 Drawing Sheets

(56) References Cited

U.S. PATENT DOCUMENTS

| | | | | | |
|---|---|---|---|---|---|
| 5,348,524 | A * | 9/1994 | Grant | A63B 21/154 | 482/130 |
| 5,522,784 | A * | 6/1996 | Grant | A63B 23/00 | 482/130 |
| 7,563,213 | B2 * | 7/2009 | Grant | A63B 21/04 | 482/122 |
| 7,998,037 | B2 * | 8/2011 | Luquette | A63B 21/0628 | 482/129 |
| 8,475,346 | B2 * | 7/2013 | Gerschefske | A63B 21/156 | 482/130 |
| 10,004,933 | B2 * | 6/2018 | Lennox | A63B 1/00 | |
| 10,953,301 | B2 * | 3/2021 | Brasch | A63B 71/0036 | |
| 11,052,280 | B1 * | 7/2021 | Massner | A63B 21/0428 | |
| 11,260,261 | B2 * | 3/2022 | Henniger | A63B 21/0428 | |
| 2005/0059535 | A1 * | 3/2005 | Kim | A63B 21/04 | 482/121 |
| 2006/0160680 | A1 * | 7/2006 | Ripley | A63B 21/156 | 482/121 |
| 2006/0189457 | A1 * | 8/2006 | Ripley | A63B 21/0552 | 482/99 |
| 2008/0039302 | A1 * | 2/2008 | Grant | A63B 21/154 | 482/121 |
| 2018/0036573 | A1 * | 2/2018 | Lennox | A63B 21/22 | |
| 2020/0114195 | A1 * | 4/2020 | Henniger | A63B 21/0552 | |
| 2020/0289866 | A1 * | 9/2020 | Gvoich | A63B 21/023 | |

* cited by examiner

Side
Perspective
2600

FITNESS MACHINE WITH ARC PLATES

CROSS-REFERENCE TO RELATED APPLICATIONS

This application claims the benefit of and priority to U.S. Provisional Patent Application Ser. No. 63/091,591 filed on Oct. 14, 2020 and entitled "STRENGTH/FITNESS MACHINE WITH ARC PLATES," which application is expressly incorporated herein by reference in its entirety. This application also claims the benefit of and priority to U.S. Provisional Patent Application Ser. No. 62/991,949 filed on Mar. 19, 2020 and entitled "EXP STRENGTH ARC PLATE," which application is expressly incorporated herein by reference in its entirety.

BACKGROUND

The term "exercise" refers to a physical activity performed by a human to improve his/her health. Exercise may be performed in an attempt to increase muscle size, to improve balance or coordination, to reduce weight, and to improve cardiovascular endurance. Different exercises or different techniques may be performed in order to work different muscles or different muscle sets.

By way of example, compound lifting movements are designed to improve how muscles perform work. Compound exercises engage multiple different sets of muscles when performing a single movement. To illustrate, the so-called "deadlift" is often considered the most intensive compound weightlifting movement because the movement works a person's gluteus maximus, quadriceps femoris, hamstrings, trapezius, latissimus dorsi, and erector spinae. Other compound exercises work other muscle sets.

Exercise equipment is often used to help build muscle or to help with recovery and therapy. FIG. 1 shows an example of an exercise machine 100 having a pulley system and a set of weights 105. Often, the weights 105 are heavy metal weights that provide a gravimetric resistance. When the user exerts a pulling force on the handle (as shown in the figure), the weights 105 provide a resistive force that enables the user to exercise his/her muscles. That is, the handle is connected to a cable which is fed through a pulley system and which is connected to the weights. The pulling force exerted using the handle results in the weights 105 being moved.

Often, the exercise machine 100 includes a sufficient number of weights 100 to provide different levels of resistance. For instance, the weights 100 may include multiple 10 pound weights and multiple 20 pound weights. Typically, the exercise machine 100 will include a selection mechanism to enable different combinations of weights to be grouped together to thereby increase the amount of resistance. For example, three 10 pound weights may be grouped together to form a 30 pound resistance.

As one can imagine, the combination of the weights 105 results in a system that is very heavy and difficult to move. The weights 105 also have a large footprint due to their large mass and size. Furthermore, the exercise machine 100 is often quite expensive simply due to the large number or amount of materials needed for its manufacture. Additionally, to prevent the exercise machine 100 from tipping over, it is often the case that the exercise machine 100 is mounted to the ground in some manner. Accordingly, traditional exercise machines are large, expensive, heavy, difficult to maneuver, and require floor mounts. What is needed, therefore, is an improved design for an exercise machine, especially for a pulley-based exercise machine.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

Embodiments disclosed herein relate to improved designs for exercise machines that facilitate muscle development and other therapeutics or therapy. Notably, the embodiments provide a selectorized system in which different resistances can be selected to complete an exercise.

In some embodiments, the machine includes a frame and a pulley assembly supported by the frame. The machine further includes a cable extending through the pulley assembly. The cable has attachments at its opposite ends, including an attachment for connecting to a pull handle, and the cable is also connected (either directly or indirectly) to a selectively variable moveable resistance unit. The selectively variable moveable resistance unit is structured to provide an elastic resistance when a pulling force is applied to the connected pull handle. Additionally, the unit is connected to the cable and includes an elastomeric body that provides the elastic resistance and an arc plate that provides a curved support member on which a portion of the elastomeric body at least partially wraps around. Movement of the arc plate, which movement is caused by the pulling force applied to the pull handle, causes the elastomeric body to stretch and to provide the elastic resistance.

In some embodiments, an exercise machine includes a frame, a pulley assembly supported by the frame, and a cable extending through the pulley assembly. The cable has attachments at its opposite ends, including an attachment for connecting to a pull handle, and the cable is also connected (either directly or indirectly) to a selectively variable moveable resistance unit. In this implementation, the selectively variable moveable resistance unit, which is structured to provide a selectively variable elastic resistance when a pulling force is applied to the connected pull handle and which is connected to the cable, comprises a first elastomeric body. The unit also includes a first arc plate that provides a first curved support member on which a portion of the first elastomeric body at least partially wraps around. The unit further includes a second elastomeric body and a second arc plate that provides a second curved support member on which a portion of the second elastomeric body at least partially wraps around. The unit further includes a selection unit for enabling different selection settings of the selectively variable moveable resistance unit. The different selection settings cause the first elastomeric body or a combination of at least the first elastomeric body and the second elastomeric body to provide the selectively variable elastic resistance. Movement of the first arc plate or the first and second arc plates, which movement is caused by the pulling force applied to the pull handle, causes the first elastomeric body or the first and second elastomeric bodies to stretch and to provide the elastic resistance.

In some embodiments, the exercise machine includes a frame, one or more guide rails that are connected to the frame and that are structured to guide connected members along a movement direction, and a height adjustment rail that is connected to the frame and that runs parallel to the one or more guide rails. The machine also includes a pulley assembly that is supported by the frame and that includes at least one pulley. This pulley is connected to the height adjustment rail and is moveable along the height adjustment rail to accommodate different heights of different exercise movements. The machine also includes a cable extending through the pulley assembly. Here, the cable has attachments at its opposite ends, including an attachment for connecting to a pull handle, and the cable is also connected (either directly or indirectly) to a selectively variable moveable resistance unit. The selectively variable moveable resistance unit is operatively connected with the one or more guide rails and is guided in the movement direction by the one or more guide rails when operated. The selectively variable moveable resistance unit is structured to provide a selectively variable elastic resistance when a pulling force is applied to the connected pull handle and is connected to the cable. The selectively variable moveable resistance unit comprises multiple elastomeric bodies that provide the selectively variable elastic resistance when the pulling force is applied to the pull handle. Different selection settings of the selectively variable moveable resistance unit causes one or a combination of multiple elastomeric bodies to be engaged to provide the selectively variable elastic resistance. The unit also includes multiple nested arc plates (e.g., the second arc plate is nested within the first arc plate, the third arc plate is nested within the second arc plate, the fourth arc plate is nested within the third arc plate, and the fifth arc plate is nested within the fourth arc plate). Each nested arc plate provides a curved support member on which a portion of a corresponding elastomeric body at least partially wraps around. The different selection settings of the selectively variable moveable resistance unit causes one or a combination of multiple nested arc plates to be engaged. Movement of whichever ones of the nested arc plates are engaged causes corresponding elastomeric bodies of whichever ones of the nested arc plates that are engaged to stretch and to provide the selectively variable elastic resistance.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims or may be learned by the practice of the invention as set forth hereinafter.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not therefore to be considered to be limiting in scope, embodiments will be described and explained with additional specificity and detail through the use of the accompanying drawings in which.

DETAILED DESCRIPTION

Figure 1:
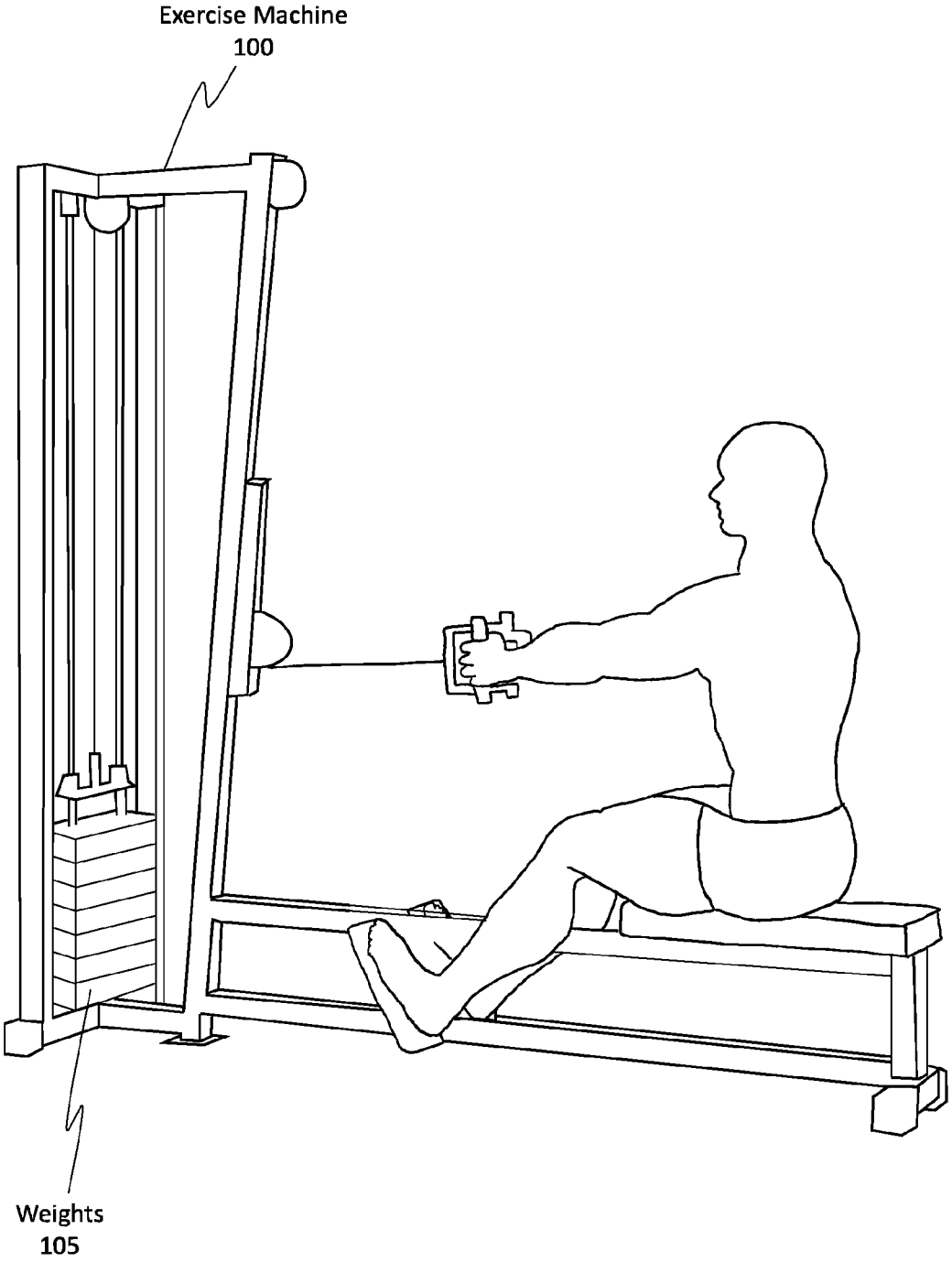
PRIOR ART Figure 1
FIG. 1 illustrates an example of a pulley-based exercise machine that uses weights to provide a gravimetric resistance.

Embodiments disclosed herein relate to improved designs for exercise machines that facilitate muscle development and other therapeutics or therapy. Notably, the embodiments provide a selectorized system in which different resistances can be selected to complete an exercise.

In some embodiments, the machine includes a frame, a pulley assembly, and cable extending through the pulley assembly. The cable has attachments, including an attachment for connecting to a pull handle, and the cable is also connected (either directly or indirectly) to a selectively variable moveable resistance unit (or "unit" for brevity). This unit is structured to provide an elastic resistance when a pulling force is applied to the pull handle. The unit is connected to the cable and includes an elastomeric body that provides the elastic resistance and also includes an arc plate that provides a curved support member on which a portion of the elastomeric body at least partially wraps around. Movement of the arc plate causes the elastomeric body to stretch and to provide the elastic resistance.

In some embodiments, the selectively variable elastic resistance unit (or "unit" for brevity) comprises a first elastomeric body and a first arc plate that provides a first curved support member on which a portion of the first elastomeric body at least partially wraps around. The unit further includes a second elastomeric body and a second arc plate that provides a second curved support member on which a portion of the second elastomeric body at least partially wraps around. The unit further includes a selection unit for enabling different selection settings of the selectively variable moveable resistance unit. The different selection settings cause the first elastomeric body or a combination of at least the first elastomeric body and the second elastomeric body to provide the selectively variable elastic resistance. Movement of the first arc plate or the first and second arc plates causes the first elastomeric body or the first and second elastomeric bodies to stretch and to provide the elastic resistance.

In some embodiments, the exercise machine includes one or more guide rails (e.g., 1, 2, 3, 4, or more than 4 guide rails) that are structured to guide connected members along a movement direction and a height adjustment rail that is connected to the frame and that runs parallel to the one or more guide rails. The machine also includes a pulley assembly that is supported by the frame and that includes at least one pulley. This pulley is connected to the height adjustment rail and is moveable along the height adjustment rail to accommodate different heights of different exercise movements. The selectively variable moveable resistance unit is operatively connected with the one or more guide rails and is guided in the movement direction by the one or more guide rails when operated. The selectively variable moveable resistance unit is structured to provide a selectively variable elastic resistance. The unit includes multiple elastomeric bodies that provide the selectively variable elastic resistance when the pulling force is applied to the pull handle. Different selection settings of the selectively variable moveable resistance unit causes one or a combination of multiple elastomeric bodies to be engaged to provide the selectively variable elastic resistance. The unit also includes multiple nested arc plates. Each nested arc plate provides a curved support member on which a portion of a corresponding elastomeric body at least partially wraps around. The different selection settings of the selectively variable moveable resistance unit causes one or a combination of multiple nested arc plates to be engaged. Movement of whichever ones of the nested arc plates are engaged causes corresponding elastomeric bodies of whichever ones of the nested arc plates that are engaged to stretch and to provide the selectively variable elastic resistance.

As used herein, the term "body" can refer to a band, a tube, or any other type of member. Therefore, the term "body" should be interpretated broadly. Additionally, the terms "connected" and "coupled" (as well as their variants) should be interpretated broadly and should not necessarily mean a rigid or even permanent connection or even a direct linkage. For example, a pulley may be attached to a weight, and a cable can run through the pulley and be attached to a handle. In this sense, the handle is coupled or connected to the weight even though they are not directly linked or attached one to another. Instead, the handle and the weight are connected indirectly via the cable. Furthermore, the cable is "connected" to the pulley even though the cable is not rigidly linked with the pulley and instead is free to move using the pulley. Manipulation of the handle results in manipulation of the weight, thereby leading the handle and the weight to be connected or coupled. As such, terms such as "connected" or "coupled" may refer to direct or even indirect linkages between different components.

Elastomeric Bodies and Elastic Resistance

Figure 2:
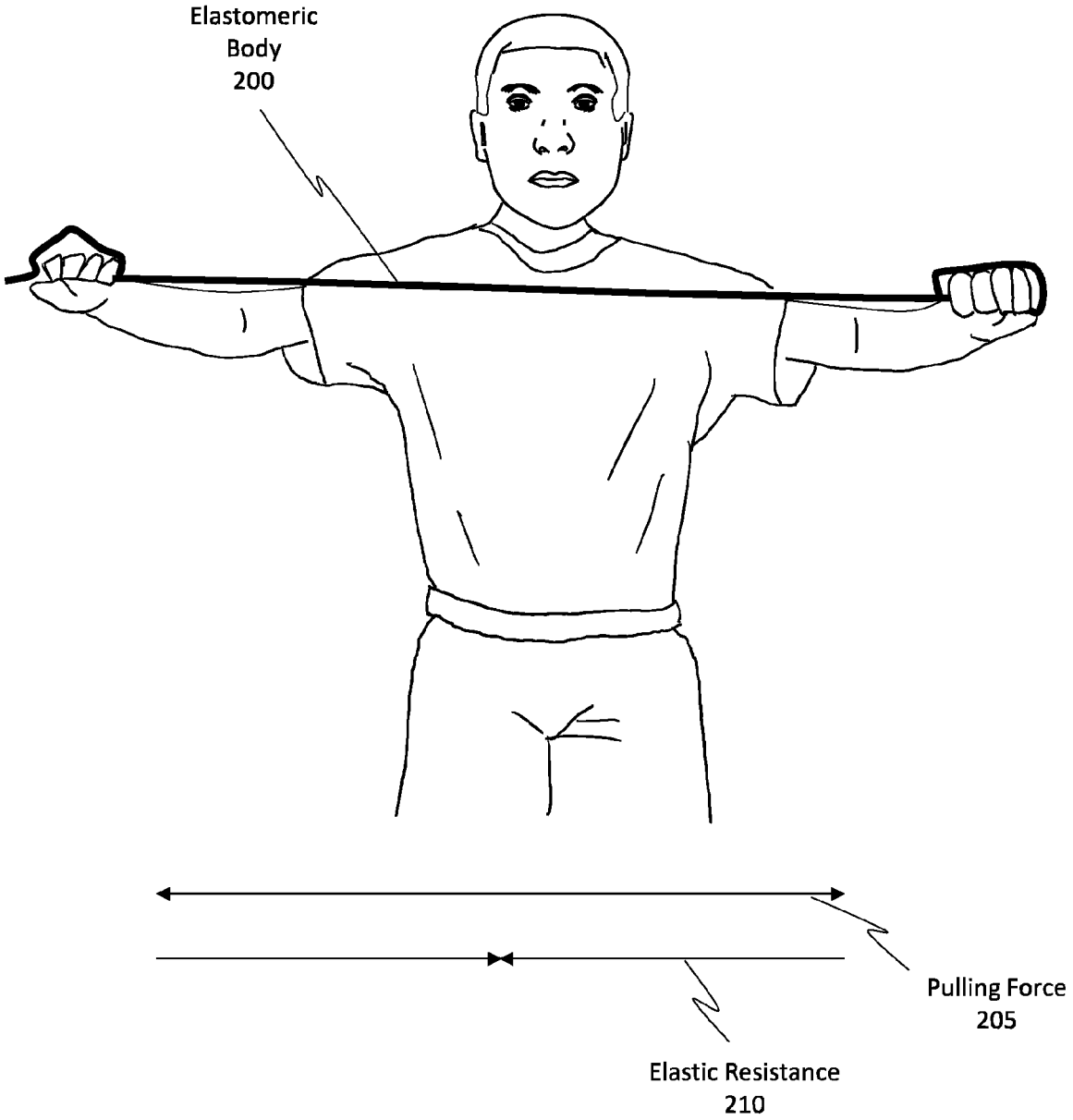
PRIOR ART Figure 2
FIG. 2 illustrates how an elastomeric body provides an elastic resistance, which may be used to perform various exercises.
Figure 3:
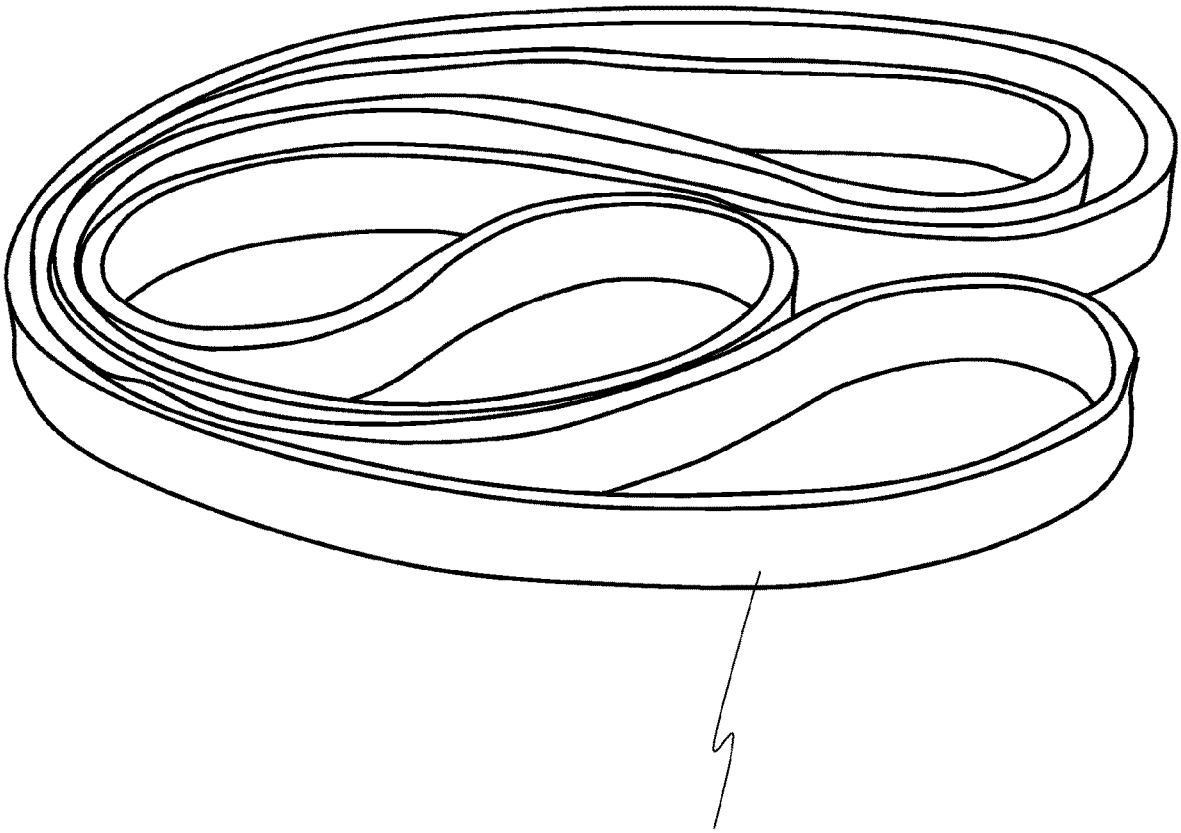
PRIOR ART Figure 3
FIG. 3 illustrates an example of an elastomeric body.

As introduced above, instead of using heavy metal weights to provide a resistive force for the exercise machine, the disclosed embodiments utilize elastomeric bodies, which provide an elastic resistance. FIGS. 2 and 3 provide additional details.

FIG. 2 illustrates an elastomeric body 200. The elastomeric body 200 can be fabricated from any type of elastomeric material. An "elastomeric material" should be interpreted broadly as including any type of material having or exhibiting elastic properties. Such materials include, but certainly are not limited to, any type of natural rubber, nitrile rubbers, ethylene propylene diene rubber, ethylene propylene rubber, styrene-butadiene block copolymers, polybutadiene, silicone elastomers, polyisoprene, fluoroelastomers, polyurethane elastomers, rubber compounds, latex, and so on, without limit. The elastomeric body 200 may be designed in different manners. For instance, the elastomeric body 200 may be implemented as heavy-duty rubber bands, springs, or even tubing. To clarify, the properties of rubber-based bands mimics that of springs and thus bands and/or springs may be used by the disclosed embodiments.

Elastic resistive bodies (e.g., the elastomeric body 200) are able to provide resistance in any direction that the body is stretched or elongated. Heavy metal weights, on the other hand, have to be moved or lifted against the gravity vector in order to produce resistance. Elastic resistance is generated in a linear manner by stretching the body. The elastic resistance is dependent on the characteristics of the body, including the body's stiffness, length, width, and thickness. Elastic resistance is dynamic in that the more the elastic body is stretched, the more force will be needed to overcome the elastic resistance.

FIG. 2 shows a pulling force 205, which is generated by the human pulling his arms in an outward direction (as indicated by the arrows) and a resulting elastic resistance 210, which is generated by the elastomeric body 200. The more the elastomeric body 200 is stretched, the more pulling force 205 will be exerted. As will be discussed in more detail later, the disclosed embodiments integrate elastic resistance (using the elastomeric bodies) and gravimetric resistance (generated based on the weight of the unit itself) in order to provide an improved exercise machine.

FIG. 3 illustrates another example of an elastomeric body 300, which is representative of the elastomeric body 200 of FIG. 2. In this example scenario, the elastomeric body 300 has no ends, or rather is non-terminating, by the fact that the body forms a loop. In some embodiments, as will be discussed in more detail later, the disclosed elastomeric bodies may have terminating ends. Accordingly, the disclosed embodiments are structured to use any type of elastomeric body and/or spring in order to provide an elastic resistance.

The resistance that is provided by the disclosed elastomeric bodies is dependent on the respective K constants of the elastic material, where F=k*x, and where "F" is the force of the body, "k" is the (spring/material) constant, and "x" is the (spring/material) stretch or compression. Different body types, widths, thicknesses, and configurations result in different K constants. The different K constants cause the bodies to provide different levels of resistance. As will be seen from this disclosure, the embodiments are highly versatile and customizable because different elastomeric bodies can be used and swapped out one with another to provide a fully customizable resistance-based workout routine. In some embodiments, the elastomeric body 300 is a tube between 1.5 inches and 2.5 inches in width. Of course, different sized bodies may be used.

Improved Exercise Machine Design

Figure 4:
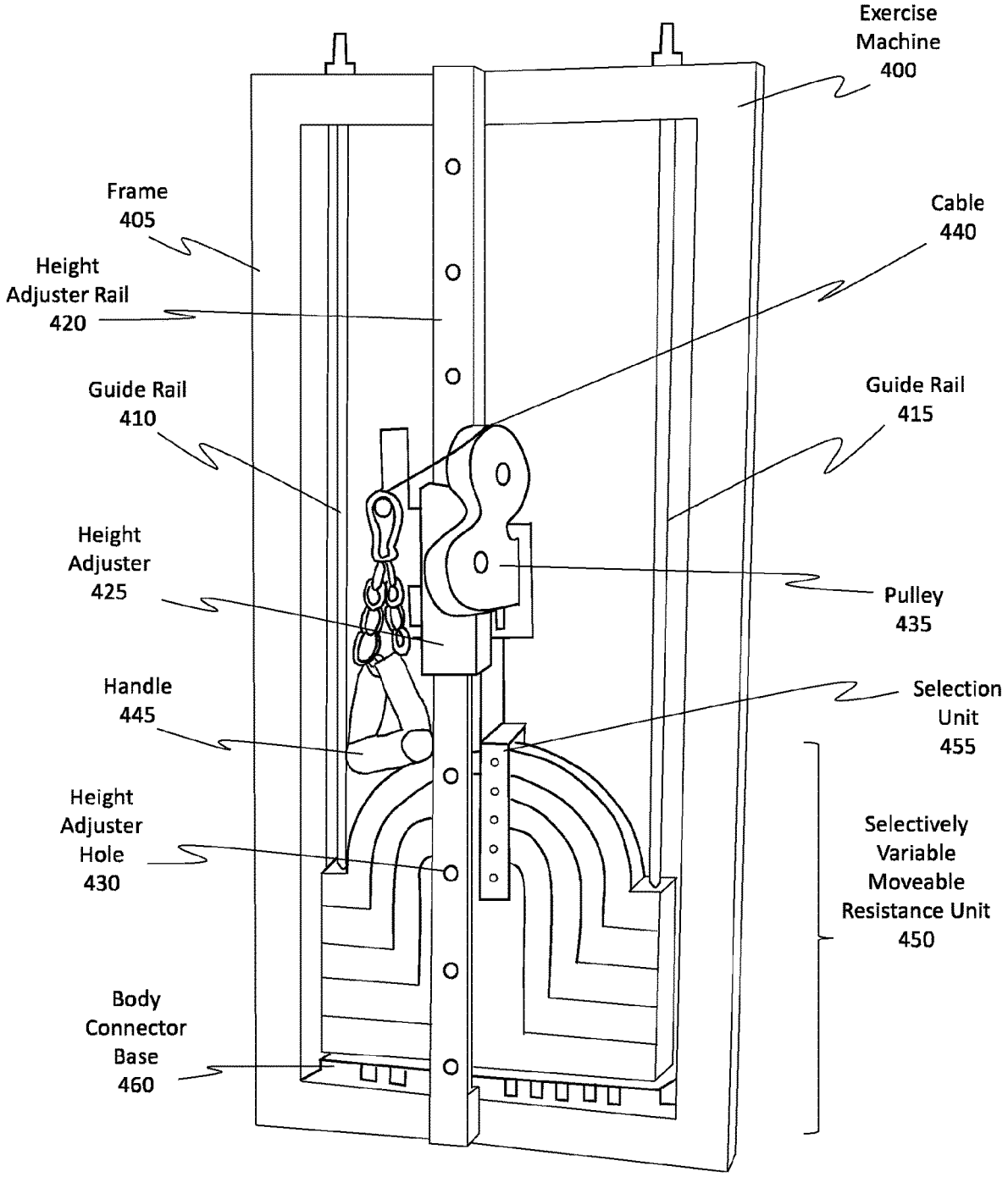
FIG. 4 illustrates an improved exercise machine that uses elastomeric bodies in lieu of heavy metal weights and that provides an elastic resistance as opposed to only a gravimetric resistance.

Having just discussed the properties of elastic resistance, attention will now be directed to FIG. 4, which illustrates how the elastomeric bodies may be used to provide elastic resistance. Using elastomeric bodies (or springs) results in a substantially lighter and more maneuverable exercise machine than what is conventionally used. Further description regarding these benefits will be provided later.

FIG. 4 shows an example exercise machine 400 that includes a frame 405 (e.g., a hollow steel frame, or some other strong material frame). The frame 405 may be made of any material, including metal, hard plastic, or any other material suitable for providing a solid and secure framework for the exercise machine 400. As shown, the frame 405 is generally rectangular in shape and has a hollow central region. In some cases, the frame 405 is between about 1000 mm and 2000 mm, and is often about 1143 mm high. In some cases, the frame 405 is between about 300 mm and 600 mm wide, and is often about 470.4 mm wide.

The exercise machine 400 also includes a guide rail 410 and a guide rail 415. Notice, the guide rails 410 and 415 run parallel to a length of the frame 405. The guide rails 410 and 415 guide any members connected thereto along a defined movement direction. In this case, the movement direction is parallel to the length of the frame 405 and the length of the guide rails 410 and 415. Depending on the orientation of the exercise machine 400, the guide rails 410 and 415 may guide the connected members along the gravity vector. The guide rails 410 and 415 are often between ⅜ inch and ½ inch in thickness, though other thicknesses may be used.

The shape of the guide rails 410, 415 can also vary. For instance, the shape may be circular or tube-like. In some cases, the shape may be triangular, square-like, or even rectangular. Other shapes may also be used. As will be described later, the guide rails fit through corresponding guide through-holes located in so-called "arc plates." One will appreciate how the shape of the guide through-holes will match the shape of the guide rails.

The exercise machine 400 also includes a height adjuster rail 420, which also runs parallel to the length of the frame 405 and the guide rails 410, 415. The height adjuster rail 420 is coupled to a height adjuster 425, which is a unit that allows a height of a frontend pulley to be modified to accommodate different exercise heights or levels. For example, the height adjuster rail 420 includes any number of height adjuster holes, such as height adjust hole 430. The height adjuster 425 can be moved along the height adjuster rail 420 and can be secured in place via use of a pin pushed through the height adjuster 425 into any one of the height adjuster holes, thereby securing the height adjuster 425 in place. In some cases, the various height adjuster holes are spaced apart one from another by about 100 mm, or anywhere between about 50 mm and 200 mm. The width of the height adjuster rail 420 is often between about 20 mm and 60 mm, and is often about 39 mm.

In this example scenario, the height adjuster 425 includes a pulley 435 which is connected to a cable 440. The cable 440 is connected to a handle 445, which is used by a person exercising on the exercise machine 400. The cable 440 is designed to support weight reaching up to even 900 pounds.

By adjusting the height of the height adjuster 425, the height or elevation of the handle 445 can be set to different levels to facilitate different exercises or movements. By way of example, setting the height of the height adjuster 425 to an upper position results in the handle 445 being relatively high. In this position, a person can perform exercises such as a lat pulldown, a close grip front lat pulldown, or a face pull. Manipulating the height adjuster 425 to a middle position along the height adjuster rail 420 can enable a person to perform exercises such as a wrap around row, a cable seated row, and so forth. Manipulating the height adjuster 425 to a lower position along the height adjuster rail 420 can enable a person to perform exercises such as should shrugs, front deltoid raises, lateral deltoid raises, and so forth.

The exercise machine 400 also includes a selectively variable moveable resistance unit 450 (or simply unit 450). As will be discussed in more detail later, the unit 450 may be made from any type of material, including metal, hard plastic, and so on. Consequently, the unit 450 has a non-negligible weight that provides at least some gravimetric resistance. In addition to the base or default gravimetric resistance, the unit 450 also provide an elastic resistance because it incorporates the use of elastomeric bodies. The unit 450 also includes a selection unit 455 that allows an operator (i.e. a person using the exercise machine 400) to engage different ones or combinations of elastomeric bodies so as to provide variable resistance. The machine 400 also includes a body connector base 460, which provides a secure platform or base to connect the elastomeric bodies to. Further details on these features will be provided later.

Arc Plates

Figure 5:
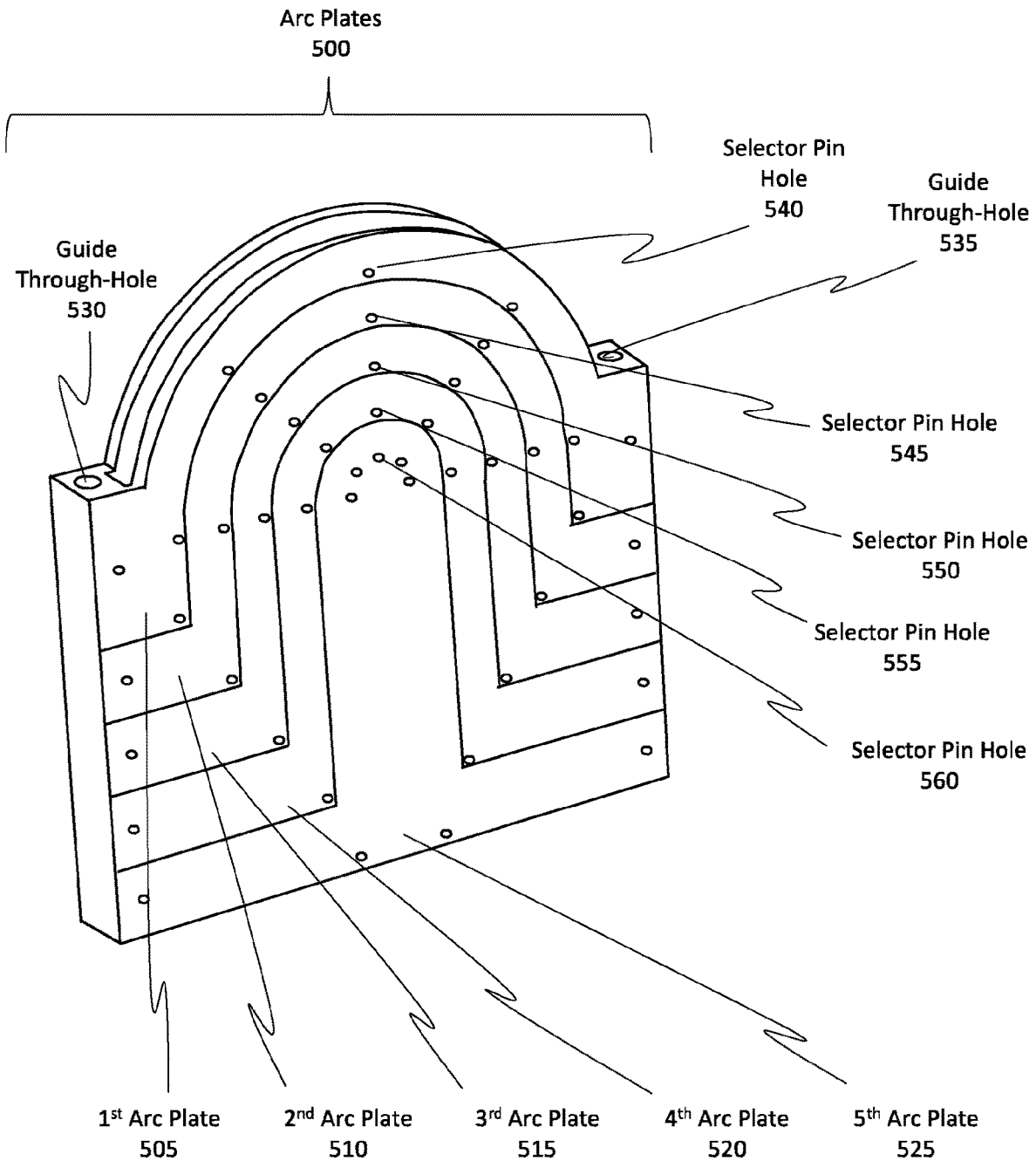
FIG. 5 illustrates an example of various arc plates that are used by the improved design.

The selectively variable moveable resistance unit 450 is comprised of a number of components, including (but not limited to) a number of arc plates and a corresponding number of elastomeric bodies. FIG. 5 provides an example illustration of the arc plates 500 that may be incorporated into the unit 450. As used herein, the term "arc" should be interpreted broadly as including any curved shape, including circular curves, ellipses, or any other ovular curves. In the examples illustrated herein, the arc plates include a half circle region on which elastomeric bodies wrap around.

In some implementations, the so-called "arc" region may be less than a half circle or more than a half circle. In some embodiments, the arc region has a uniform radius. That is, the curved support member can have a uniform curvature radius for areas where the elastomeric body is wrapped around such that the curved support member forms a half circle having a uniform curvature radius. In some embodiments, the arc region is an ellipse having two different radii (e.g., a semimajor axis and a semiminor axis). Accordingly, the term "arc" should be interpreted broadly as including a surface that is curved in any manner. For non-circular arcs, a peak or a cone may be provided and may result in additional stress on the elastomeric body. Consequently, it may be the case that low resistance elastomeric bodies (e.g., bodies that provide less than 10 or 20 pounds of resistive force) are used for arcs that have peaks and high resistance elastomeric bodies are refrained from being used at those arc plates.

The arc plates 500 include a $1^{st}$ arc plate 505, a $2^{nd}$ arc plate 510, a $3^{rd}$ arc plate 515, a $4^{th}$ arc plate 520, and a $5^{th}$ arc plate 525. Although only five arc plates are illustrated, one will appreciate how the unit 450 may include more or less arc plates. For example, the unit 450 may include 1, 2, 3, 4, 5, 6, 7, 8, 9, 10, or perhaps even more than 10 arc plates. In the configuration shown in FIG. 5, the set of arc plates 500 is approximately between about 10 inches and 20 inches tall, and is often about 14.5 inches tall. The guide rails mentioned earlier are often around 40 inches tall, though different heights may be used. Consequently, the elastomeric bodies can freely stretch within the 40 inch bounds provided by the frame, which (in total) is between about 30 inches and 60 inches, and is often around 44 or 45 inches. The unit as a whole (i.e. the exercise machine) is often between about 10 inches and 30 inches wide, and is often about 18.5 inches wide. The unit as a whole is also often between about 30 inches and 60 inches tall, and is often about 45 inches tall. The unit (as a whole) often weighs under 40 pounds, as will be described in more detail later.

Each arc plate is provided with a first guide through-hole and a second guide through-hole through which one of the guide rails 410, 415 fits through. For example, FIG. 5 shows how the $1^{st}$ arc plate 505 includes a guide through-hole 530 and a guide through-hole 535. The other arc plates also have corresponding guide through-holes.

Figure 6:
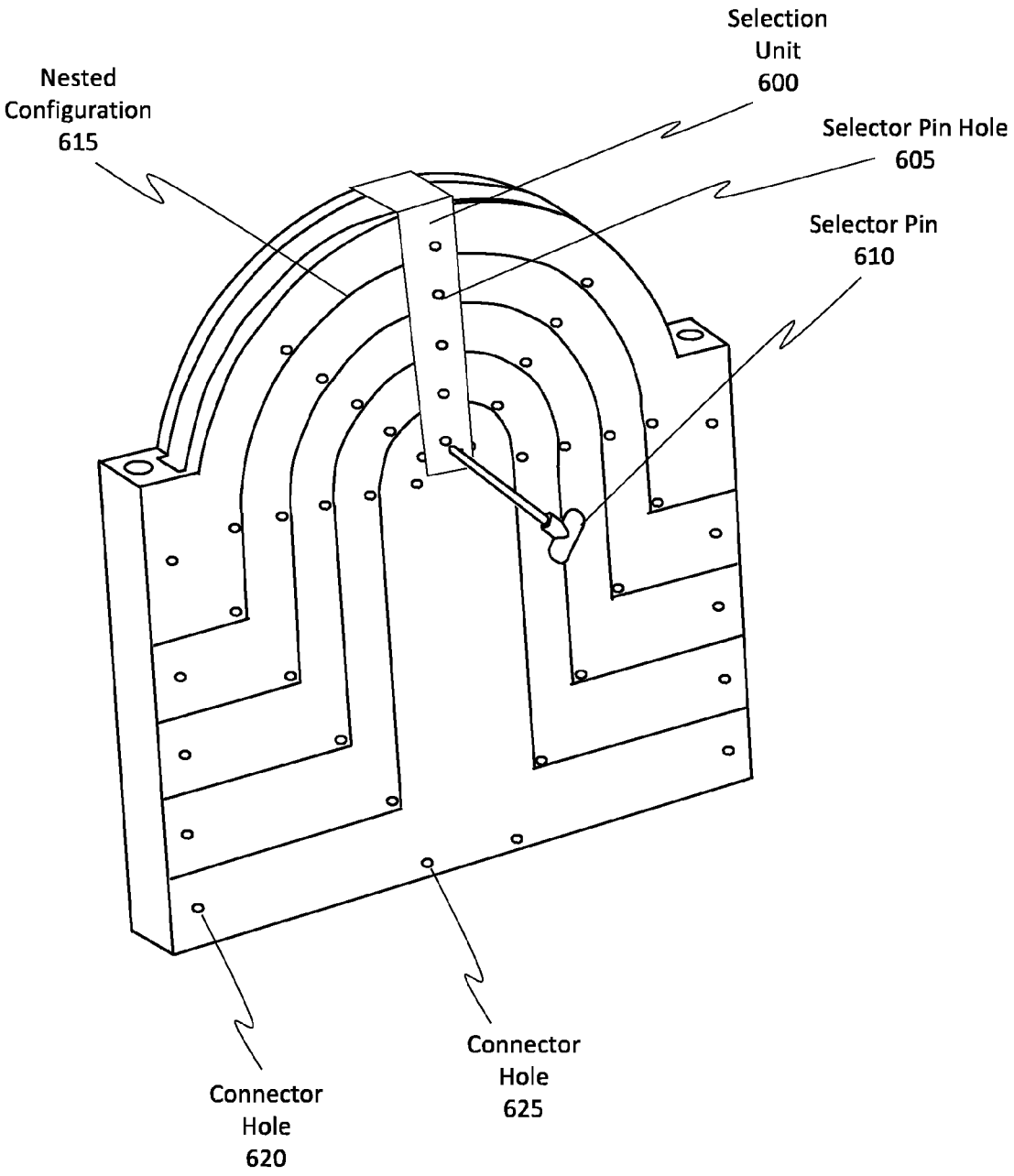
FIG. 6 illustrates how a selection unit may be used to engage different levels of elastic resistance.

In order to engage different ones of the arc plates, each of the arc plates is equipped with a corresponding selector pin hole. To illustrate, the $1^{st}$ arc plate 505 includes a selector pin hole 540; the $2^{nd}$ arc plate 510 includes a selector pin hole 545; the $3^{rd}$ arc plate 515 includes a selector pin 550; the $4^{th}$ arc plate 520 includes a selector pin hole 555; and the $5^{th}$ arc plate 525 includes a selector pin hole 560. Notice, the selector pin holes are in-line with one another and are arranged in a manner so as to be parallel to the guide rails. The selection unit 455 from FIG. 4 operates in conjunction with the various selector pin holes. FIG. 6 illustrates how the selection mechanism operates.

FIG. 6 shows a selection unit 600, which corresponds to the selection unit 455 from FIG. 4. The selection unit 600 fits overtop of the various arc plates and includes a same number of selector pin holes as the arc plates. For example, the selection unit 600 includes a selection pin hole 605. Here, the selection pin hole 605 is disposed over the selector pin hole 545, which is the pin hole for the $2^{nd}$ arc plate 510. The selector pin 610 is shown as being inserted into the selector pin hole for the $5^{th}$ arc plate. Consequently, a combination of the $1^{st}$, $2^{nd}$, $3^{rd}$, $4^{th}$, and $5^{th}$ arc plates will be engaged and a combination of those plates elastomeric bodies will provide elastic resistance.

In accordance with the disclosed principles, an operator can use a selector pin 610 to engage one or a combination of multiple arc plates in order to set a desired elastic resistance. Notice, the arc plates are currently in a nested configuration 615, meaning that one arc plate is nested within another arc plate, and so on and so forth. Further details on this nested configuration will be provided momentarily.

The arc plates also include a number of connector holes, including connector hole 620 and connector hole 625. These holes are provided to secure or fasten a front end of the arc plate to a backend of the arc plate. Further details will be provided later. Bolts, screws, dowels, or any other connection mechanism may be used for such connections.

Figure 7:
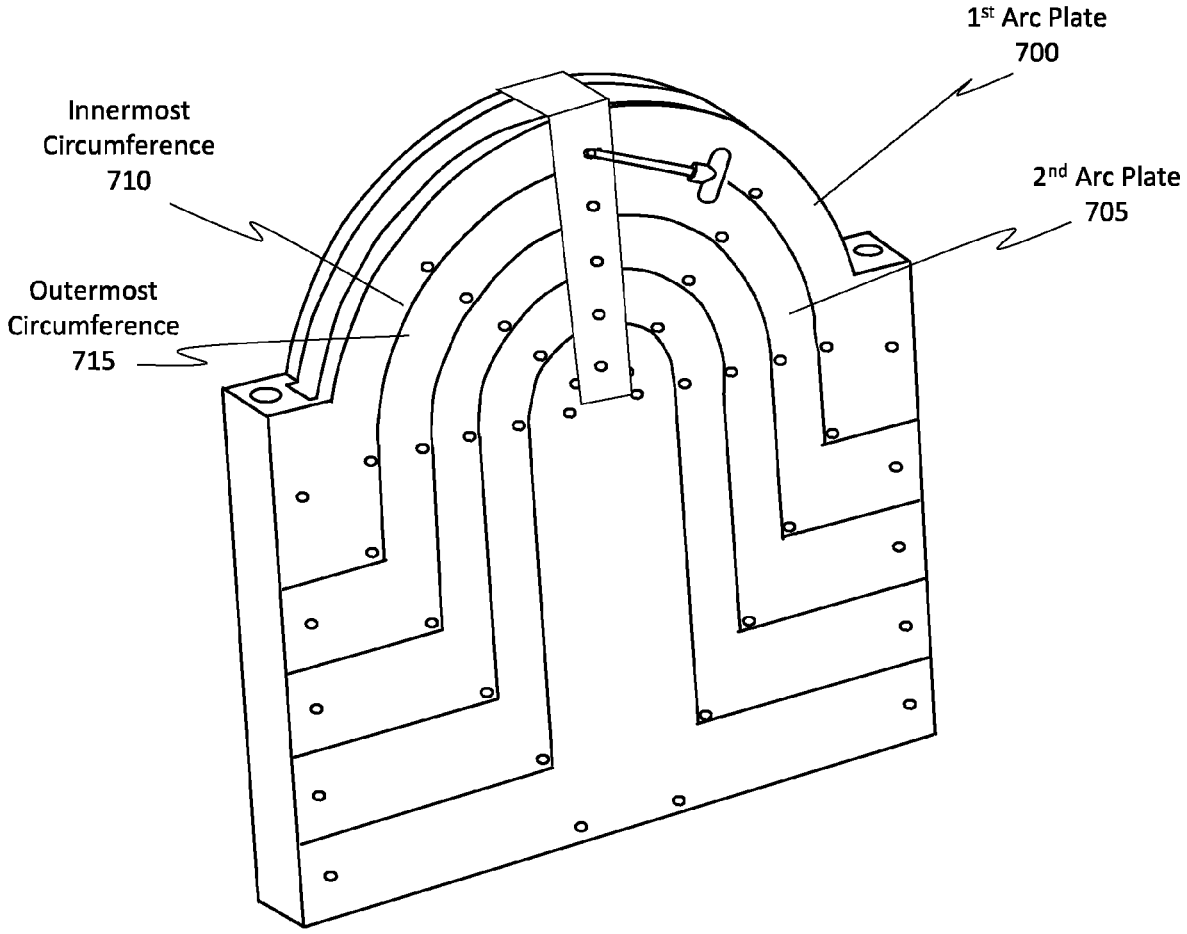
FIG. 7 illustrates another scenario where the selection unit is being used.

FIG. 7 shows a different scenario in which the selector pin is being used to engage a different number of arc plates. Here, the selector pin is being inserted into the selector pin hole of the $1^{st}$ arc plate. Consequently, only the elastomeric body associated with the $1^{st}$ arc plate will be engaged and will provide elastic resistance. In some embodiments, the $1^{st}$ arc plate is always engaged, regardless of whether the selector pin is inserted into the selector pin hole of the $1^{st}$ arc plate. For instance, it may be the case that a permanent coupling (e.g., a bolt) is present between the selection unit and the $1^{st}$ arc plate, resulting in the $1^{st}$ arc plate always being engaged to prevent freefall of the handle.

FIG. 7 shows the $1^{st}$ arc plate 700 and the $2^{nd}$ arc plate 705. Recall, in this scenario, the arc plates are in a nested configuration. Here, the innermost circumference 710 of the $1^{st}$ arc plate 700 is within a threshold value of the outermost circumference 715 of the $2^{nd}$ arc plate 705. As a consequence, the $2^{nd}$ arc plate 705 can tightly fit underneath, or be "nested" within, the $1^{st}$ arc plate 700. The innermost and outermost circumferences of the other arc plates are designed in a similar manner to facilitate the nesting configuration. Specific details regarding the circumferences will be provided later. Accordingly, an outermost circumference of the second arc plate (or a nested arc plate) is within a minimum threshold value of an innermost circumference of the first arc plate (or a nestling arc plate) to enable the second arc plate to be nested within the first arc plate.

Figure 8:
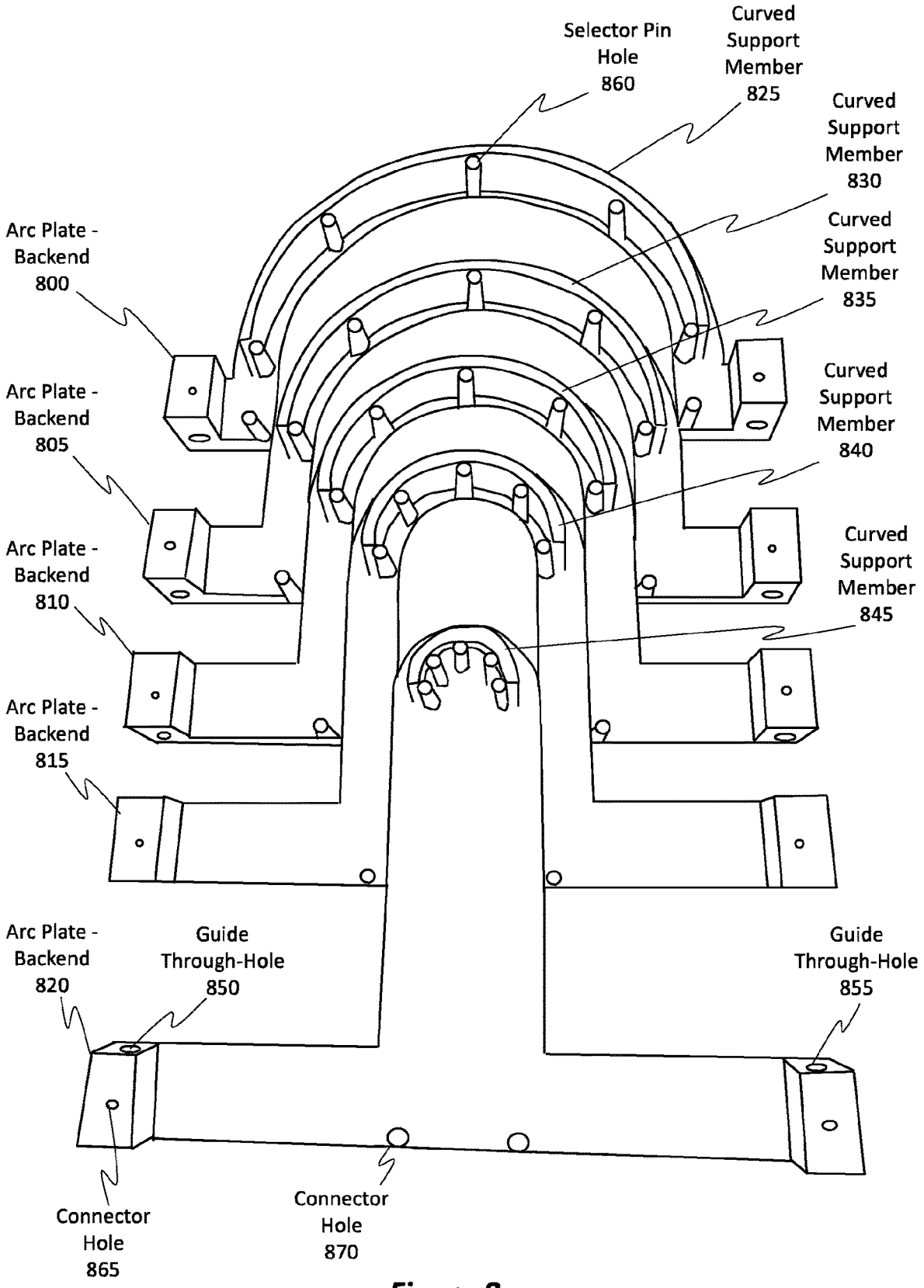
FIG. 8 illustrates various views of backend parts of the arc plates.
Figure 9:
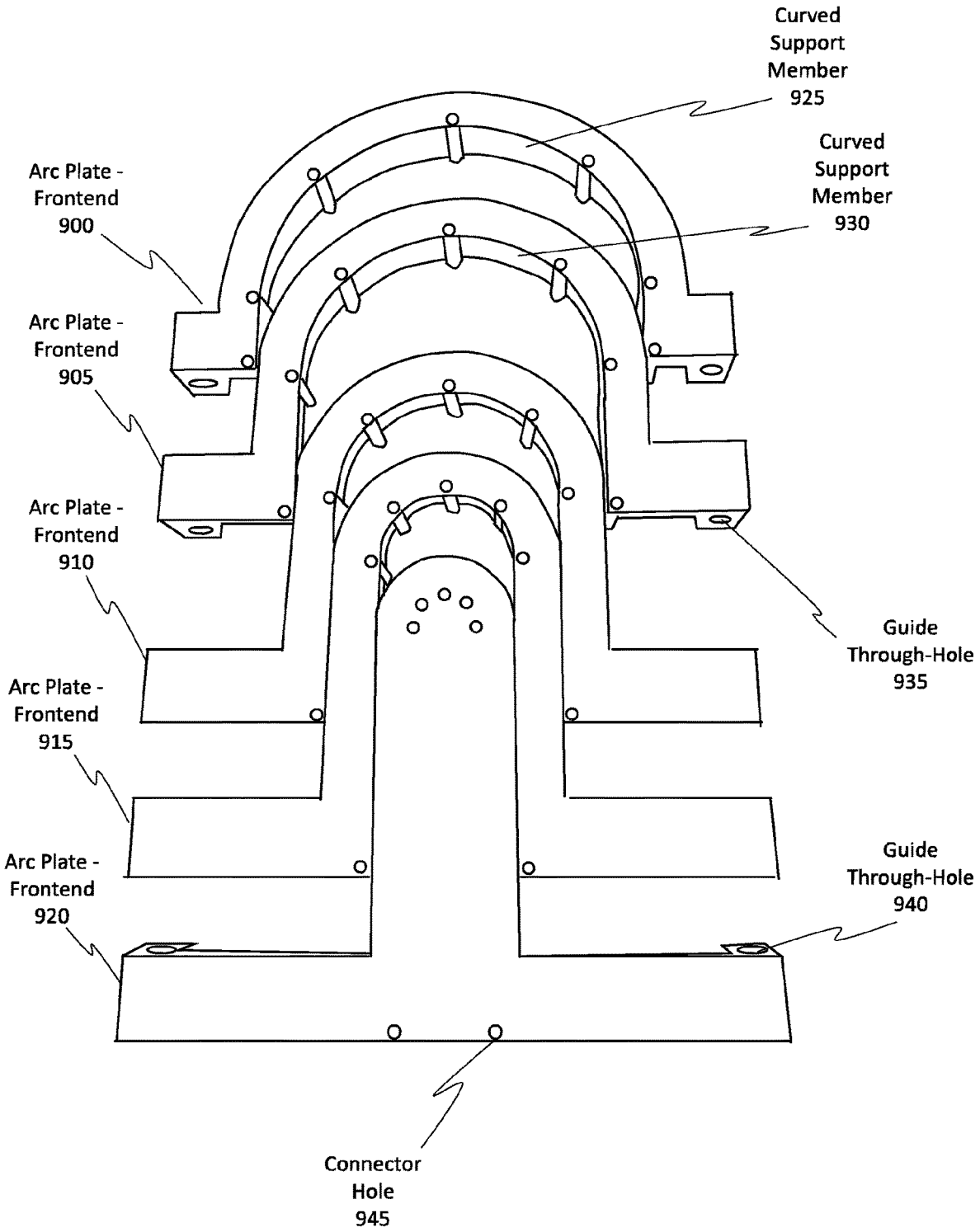
FIG. 9 illustrates various views of frontend parts of the arc plates.

Each arc plate is comprised of a frontend and a backend portion. FIG. 8 illustrates the backend portions while FIG. 9 illustrates the frontend portions. The two portions are coupled one to another via the connector holes that were mentioned earlier. The coupling may occur via a bolt and nut coupling arrangement, a snap rivet arrangement, a dowel, or any other type of coupling mechanism.

FIG. 8 shows an arc plate-backend 800, which is the backend for the $1^{st}$ arc plate; an arc plate-backend 805, which is the backend for the $2^{nd}$ arc plate; an arc plate-backend 810, which is the backend for the $3^{rd}$ arc plate; an arc plate-backend 815, which is the backend for the $4^{th}$ arc plate; and an arc plate-backend 820, which is the backend for the $5^{th}$ arc plate. Each arc plate is equipped with a curved support member on which a corresponding elastomeric body rests on or wraps around (to be illustrated later). Specifically, the arc plate-backend 800 includes a curved support member 825; the arc plate-backend 805 includes a curved support member 830; the arc plate-backend 810 includes a curved support member 835; the arc plate-backend 815 includes a curved support member 840; and the arc plate-backend 820 includes a curved support member 845. The illustration provided by FIG. 8 shows the various arc plates in a partial nested configuration, meaning that the arc plates are not flush on with another.

FIG. 8 also shows the various guide through-holes, such as guide through-hole 850 and guide through-hole 855. Additionally, FIG. 8 shows the various selector pin holes, such as selector pin hole 860. Finally, FIG. 8 also shows the various connector holes (which are used to couple the backend to the frontend), such as connector hole 865 and connector hole 870.

FIG. 9 shows an arc plate-frontend 900, which is the frontend for the $1^{st}$ arc plate; an arc plate-frontend 905, which is the frontend for the $2^{nd}$ arc plate; an arc plate-frontend 910, which is the frontend for the $3^{rd}$ arc plate; an arc plate-frontend 915, which is the frontend for the $4^{th}$ arc plate; and an arc plate-frontend 920, which is the frontend for the $5^{th}$ arc plate. As discussed, the frontends shown in FIG. 9 couple with the backends of FIG. 8 to form the various arc plates.

FIG. 9 shows how, in some embodiments, the frontends may include curved support members (e.g., curved support members 925 and 930), guide through-holes (e.g., guide through-hole 935, 940), and connector holes (e.g., connector hole 945).

Figure 10:
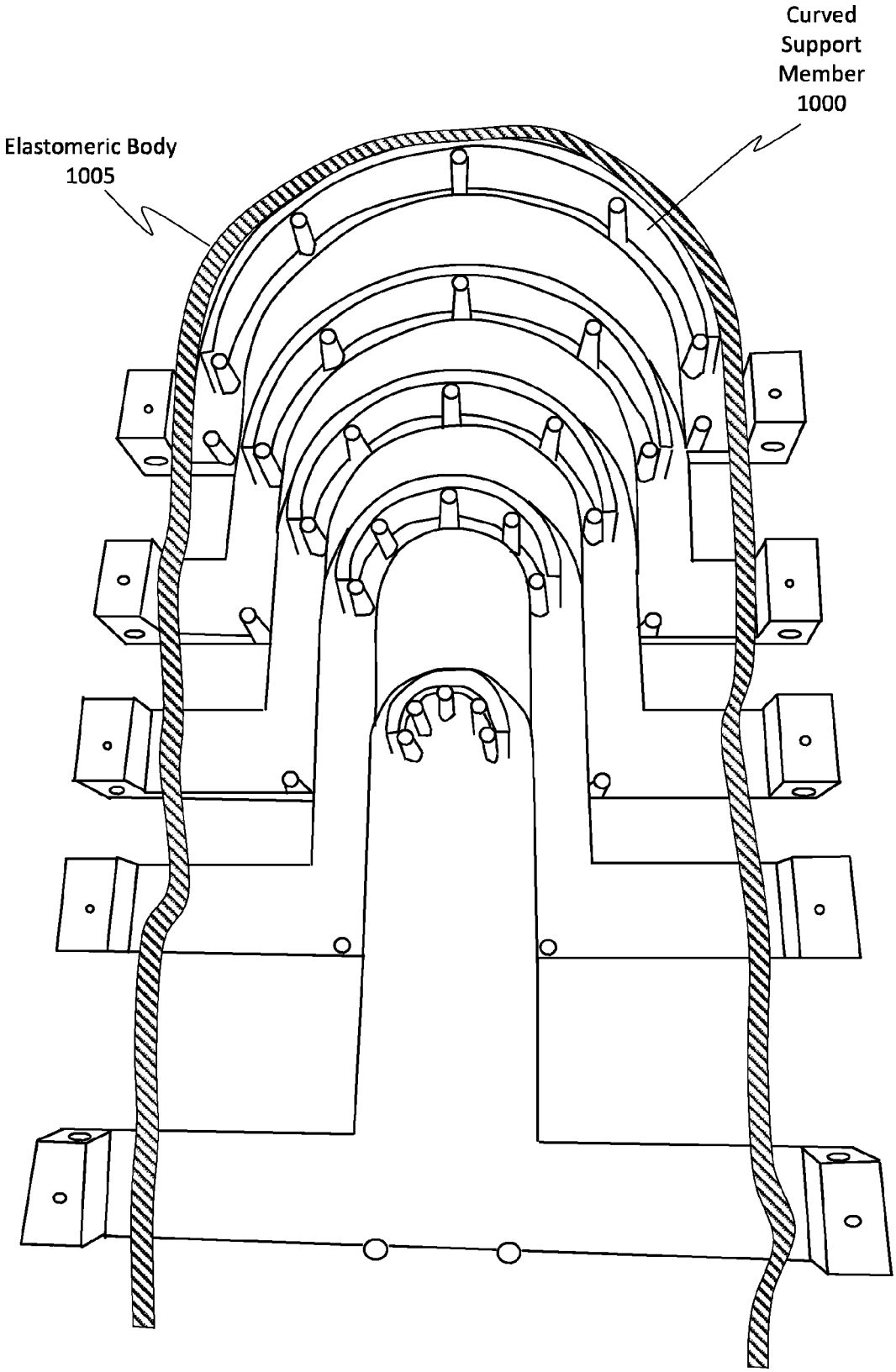
FIG. 10 illustrates how an elastomeric body can at least partially wrap around a curved support member of the arc plate.

FIG. 10 again shows the backend of the arc plates. FIG. 10 also shows how the arc plates may be equipped with elastomeric bodies. To illustrate, FIG. 10 shows a curved support member 1000, which is representative of the curved support member 825 from FIG. 8 and which is the curved support member for the $1^{st}$ arc plate, and an elastomeric body 1005. Notice, the elastomeric body 1005 at least partially wraps around the curved support member 1000. Movement of the $1^{st}$ arc plate causes the elastomeric body 1005 to stretch and to provide the elastic resistance.

In some embodiments, each arc plate may support or accommodate 2 separate elastomeric bodies. For instance, it may be the case that the curved support member 1000 supports not only the elastomeric body 1005 but also supports a second elastomeric body. More than two bodies may also be used for each arc plate. Furthermore, the body connector base can also support more than one elastomeric body per corresponding connection hole, as will be discussed in more detail later.

Typically, the $1^{st}$ arc plate (or rather, the elastomeric body associated with the $1^{st}$ arc plate) provides a lighter resistance than the $2^{nd}$ arc plate (or rather, the elastomeric body associated with the $2^{nd}$ arc plate). The $2^{nd}$ arc plate typically provides a lighter resistance than the $3^{rd}$ arc plate. The $3^{rd}$ arc plate typically provides a lighter resistance than the $4^{th}$ arc plate. The $4^{th}$ arc plate typically provides a lighter resistance than the $5^{th}$ arc plate. That being said, the bodies are fully customizable and swappable to accommodate any desired arrangement, even one that is opposite of the above description. In some cases, the resistance provided by the $1^{st}$ arc plate (and coupled elastomeric body) can have a maximum elastic resistance equivalent to about 8 pounds, 9 pounds, 10 pounds, or more or less. Indeed, use of different types of elastomeric bodies results in different resistance amounts. The machine is fully customizable and the arc plates can support different types of elastomeric bodies and resistances.

The disclosed elastomeric bodies provide a resistance that dynamically changes/increases based on the degree or amount by which the body is stretched. The more the body is stretched, the more resistance is provided. In some cases, the stretch amount of the body can reach even beyond three times the body's original length before that body begins to strain. For every amount the body stretches, the resistive force grows exponentially.

Figure 11:
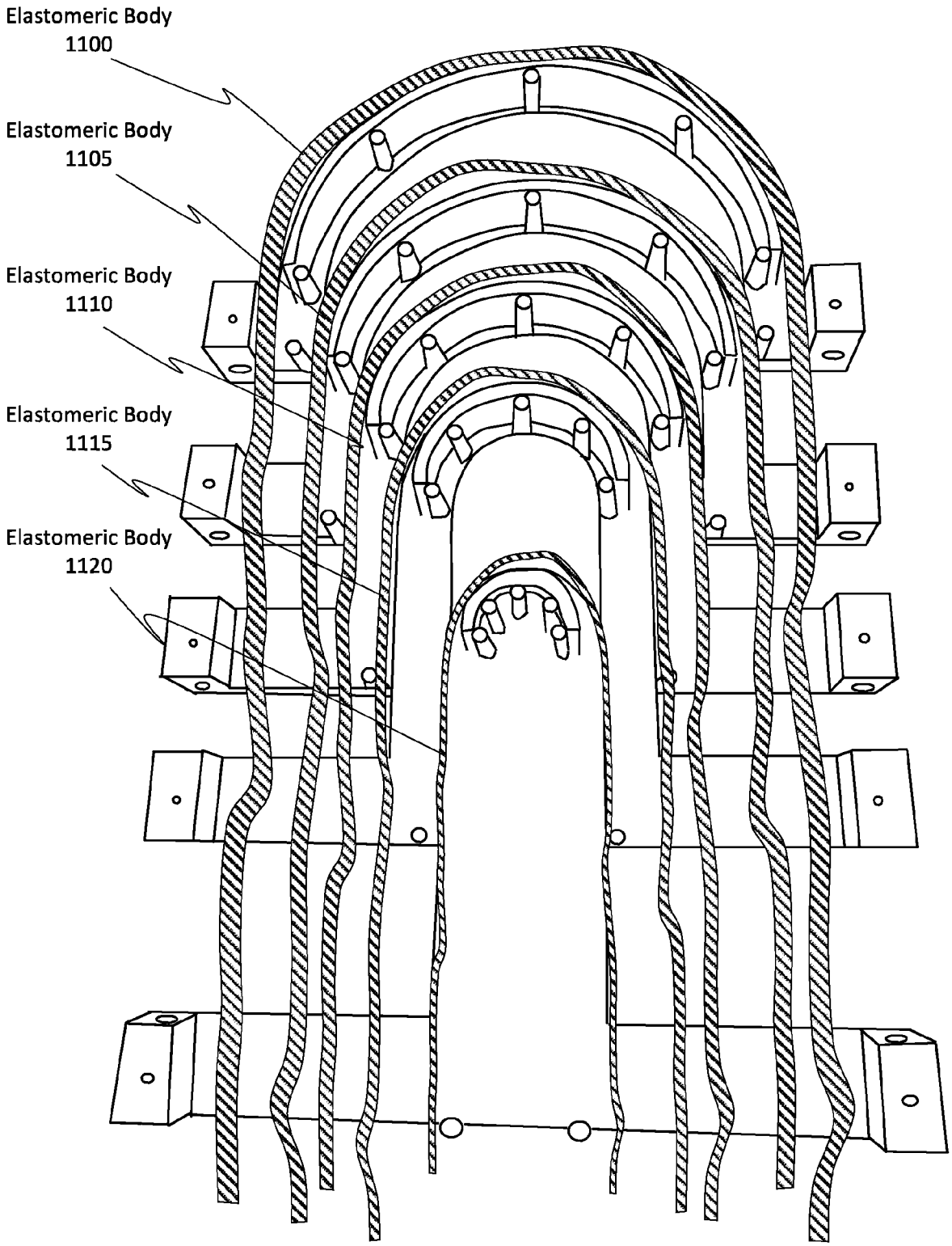
FIG. 11 illustrates how multiple elastomeric bodies may be simultaneously used.

FIG. 11 shows a more complete illustration. Specifically, FIG. 11 shows how an elastomeric body 1100 is provided for the $1^{st}$ arc plate; an elastomeric body 1105 is provided for the $2^{nd}$ arc plate; an elastomeric body 1110 is provided for the $3^{rd}$ arc plate; an elastomeric body 1115 is provided for the $4^{th}$ arc plate; and an elastomeric body 1120 is provided for the $5^{th}$ arc plate. In this configuration, there are five total bodies. In some cases, however, one or more of the arc plates may support multiple arc bodies. Consequently, the arc plate configuration shown in FIG. 11 may support anywhere from 1 body to 10 bodies, and perhaps even more than 10 bodies (e.g., in a scenario where an arc plate supports more than two elastomeric bodies, such as perhaps 3, 4, 5, or more than 5 bodies).

Figure 12:
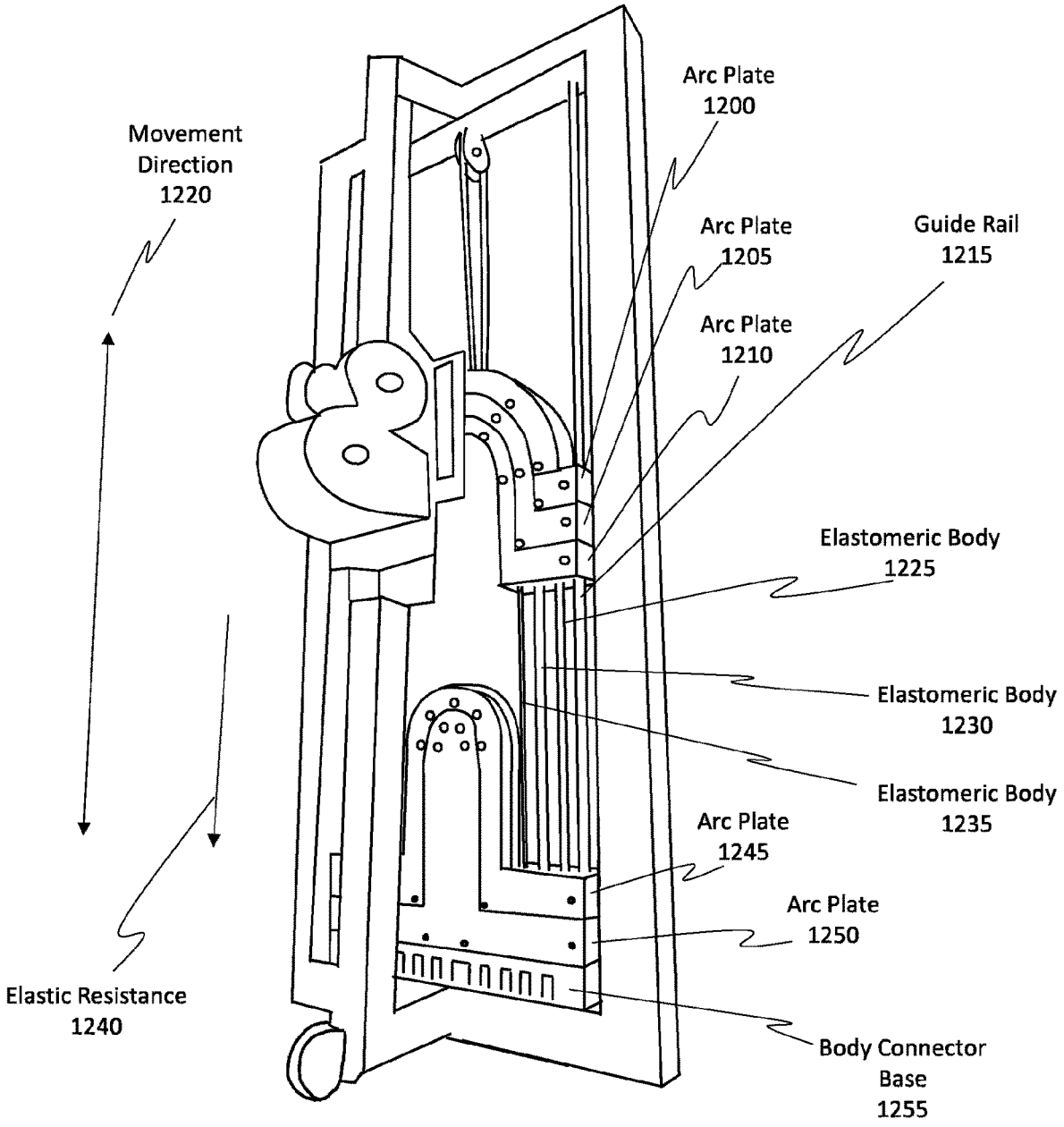
FIG. 12 illustrates a scenario in which some of the elastomeric bodies (e.g., three bodies) are currently engaged using the selection unit to provide an elastic resistance.

Using the selector pin (e.g., selector pin 610 from FIG. 6) in combination with the different selector pin holes allows different ones of the arc plate and elastomeric body combinations to be engaged, resulting in the ability to modify how much elastic resistance is provided by the exercise machine. FIG. 12 is illustrative.

FIG. 12 shows an arc plate 1200 (i.e. the $1^{st}$ arc plate), an arc plate 1205 (i.e. the $2^{nd}$ arc plate), and an arc plate 1210 (i.e. the $3^{rd}$ arc plate). These three arc plates are engaged as a result of the selector pin being inserted into the selector pin hole of the $3^{rd}$ arc plate. To clarify, when the selector pin is inserted into the selector pin hole of the $1^{st}$ arc plate, only the $1^{st}$ arc plate is engaged. When the selector pin is inserted into the selector pin hole of the $2^{nd}$ arc plate, both the $1^{st}$ and the $2^{nd}$ arc plates are simultaneously engaged. When the selector pin is inserted into the selector pin hole of the $3^{rd}$ arc plate, the $1^{st}$, $2^{nd}$, and $3^{rd}$ arc plates are simultaneously engaged. When the selector pin is inserted into the selector pin hole of the $4^{th}$ arc plate, the $1^{st}$, $2^{nd}$, $3^{rd}$, and $4^{th}$ arc plates are simultaneously engaged. When the selector pin is inserted into the selector pin hole of the $5^{th}$ arc plate, the $1^{st}$, $2^{nd}$, $3^{rd}$, $4^{th}$, and $5^{th}$ arc plates are simultaneously engaged.

Notice, the guide rail 1215 is provided to guide a movement of the engaged arc plates along a movement direction 1220. As a result of the selector pin being inserted into the selector pin hole of the $3^{rd}$ arc plate, three elastomeric bodies are engaged and will provide elastic resistance. To illustrate, the elastomeric bodies 1225, 1230, and 1235 are currently being stretched and are currently and simultaneously provided an elastic resistance. The elastomeric body 1225 is the body associated with the $1^{st}$ arc plate (i.e. arc plate 1200); the elastomeric body 1230 is the body associated with the $2^{nd}$ arc plate (i.e. arc plate 1205); and the elastomeric body 1235 is the body associated with the $3^{rd}$ arc plate (i.e. arc plate 1210). Not shown are the elastomeric bodies associated with the $4^{th}$ and $5^{th}$ arc plates. Those bodies are currently hidden from view because those arc plates are not being raised. Accordingly, the elastomeric bodies 1225, 1230, and 1235 are currently providing an elastic resistance 1240.

The arc plates 1245 and 1250 are not engaged and thus their respective elastomeric bodies are not contributing to the elastic resistance 1240. In some embodiments (though not all), terminal ends of the elastomeric bodies (e.g., elastomeric bodies 1225, 1230, and 1235) are secured or fixed to a body connector base 1255 to secure those bodies to a fixed position so that they can flex and stretch freely.

Figure 13:
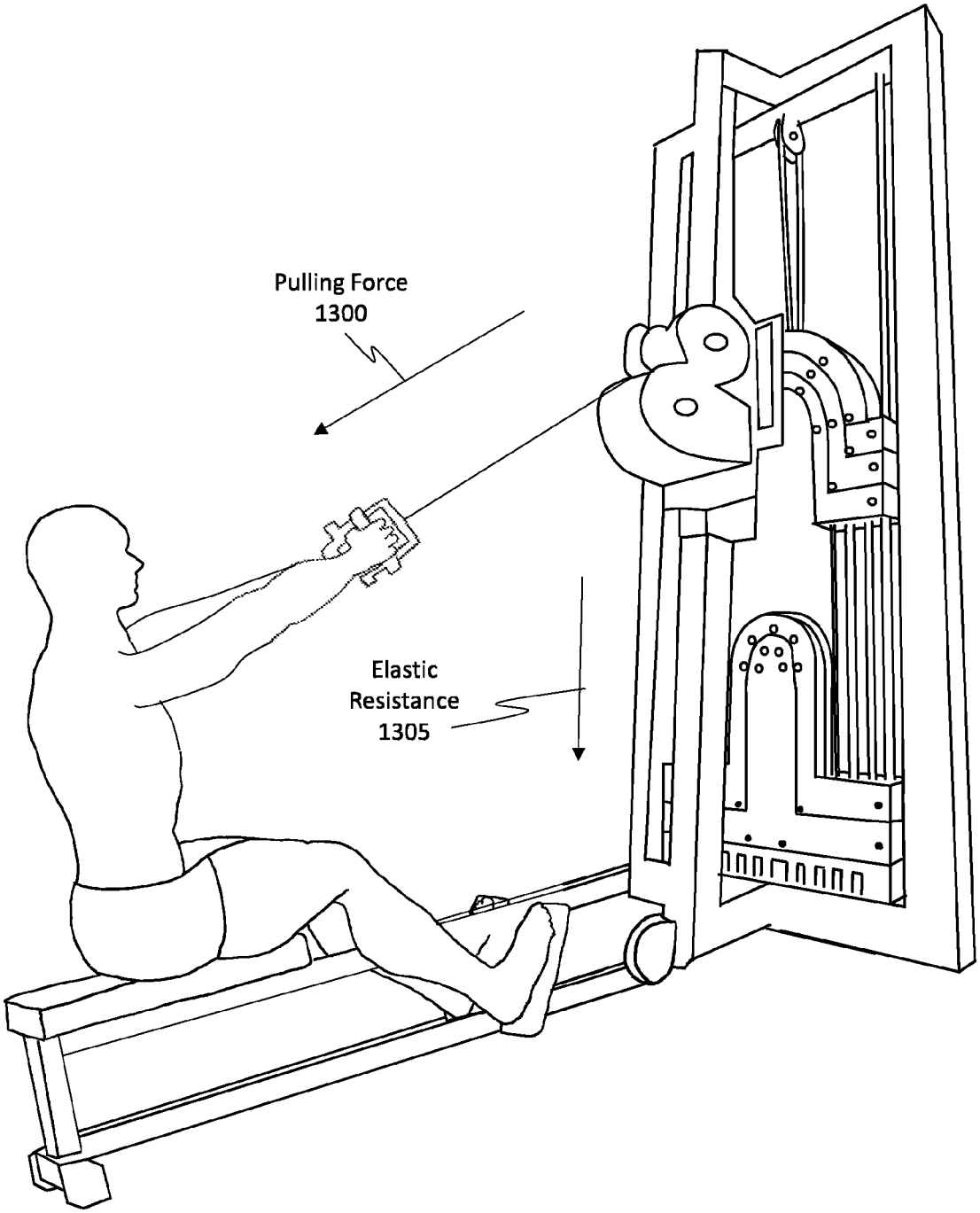
FIG. 13 illustrates a scenario in which a pull force, which is provided by a human, is causing the arc plates to move, which movement results in the elastomeric bodies being stretched and which produces an elastic resistance.

FIG. 13 shows a scenario where a person is exercising using the exercise machine. Notice, the person is exerting a pulling force 1300. This pulling force is translated through the cable, which is connected to the selectively variable moveable resistance unit. In this case, three arc plates are engaged, and those arc plates' respective elastomeric bodies are providing the elastic resistance 1305. The person is able to exercise using this pulley-based exercise machine in a similar manner as conventional pulley-based machines that use heavy metal weights. Some significant differences include the fact that the elastic resistance 1305 actually increases the more the elastomeric bodies are stretched, meaning that the resistance increases throughout the pulling motion of the user. That is, the selectively variable elastic resistance dynamically increases based on a stretch amount of the first elastomeric body and/or the second elastomeric body (and/or the other elastomeric bodies).

On the contrary, the resistance provided by heavy metal weights remains constant throughout the pulling motion of the user. Another significant difference is that the entire weight of the exercise machine is significantly lighter as compared to machines that rely on heavy metal weights to provide their resistances.

Arc Plate Dimensions

Figure 14:
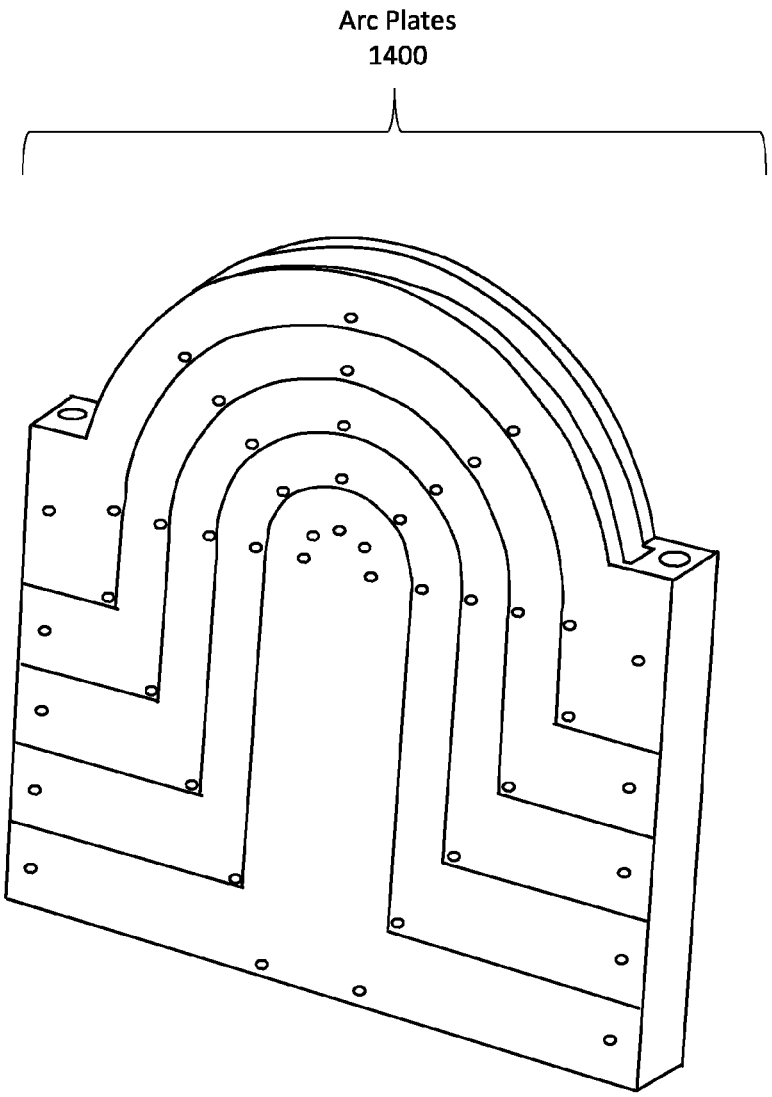
FIG. 14 illustrates another view of the arc plates.

Having introduced how the selectively variable moveable resistance unit operates, attention will now be turned to dimensions of the arc plates. FIG. 14 provides another example view of the arc plates 1400 in a nested configuration. FIGS. 15 through 19 provide separate views of each respective arc plate, along with that arc plate's corresponding dimensions.

Figure 15:
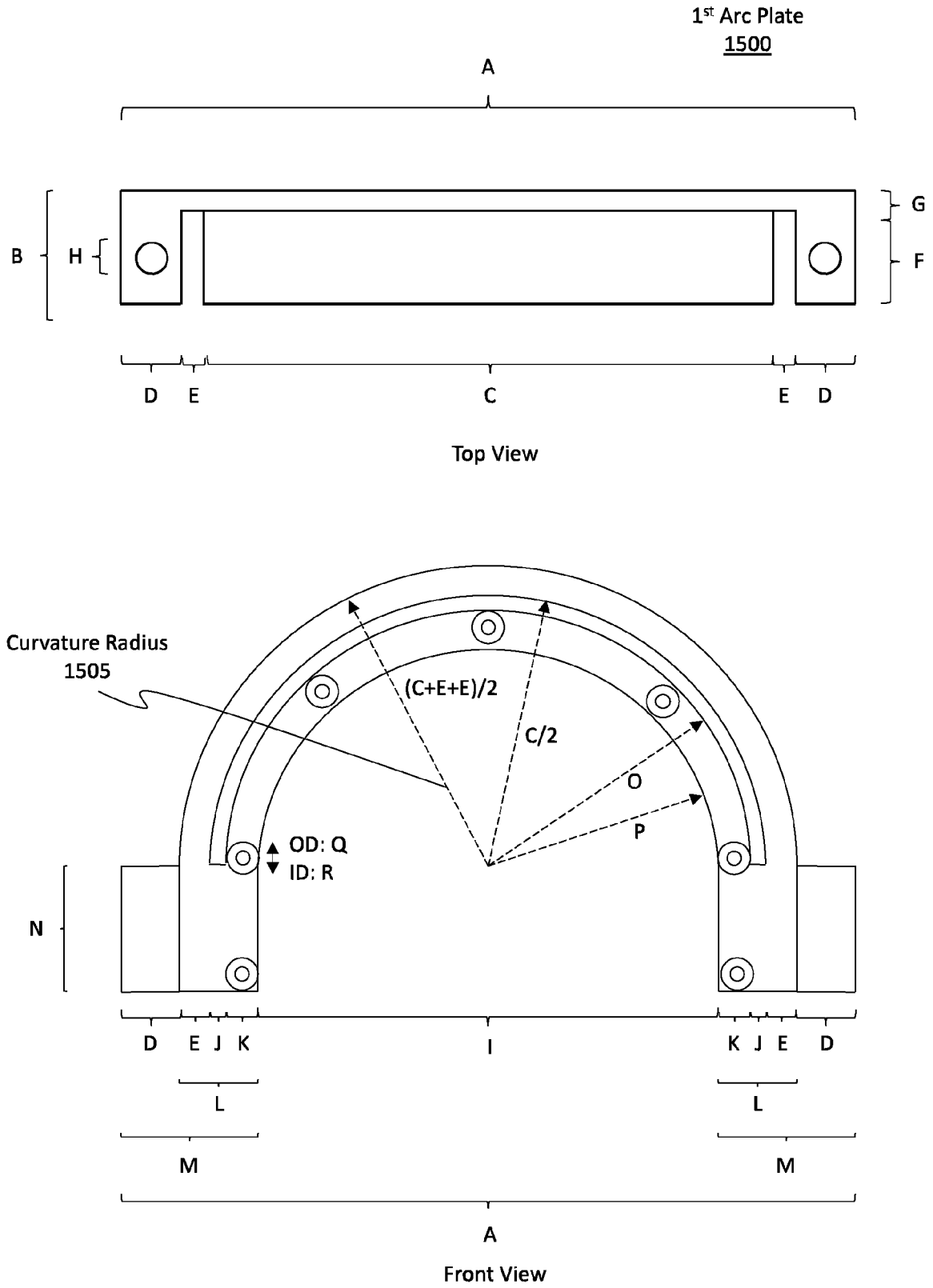
FIG. 15 illustrates a top and side perspective views of the $1^{st}$ arc plate, along with its dimensions.

FIG. 15 shows a top view of the 1$^{st}$ arc plate 1500. The length of the 1$^{st}$ arc plate 1500 is shown as being dimension "A" and the width is shown as being dimension "B." The length of the 1$^{st}$ arc plate 1500 is shown as having a section "D" for the guide through-holes, a section "E" through which the elastomeric body is placed, and a dimension "C" on which the elastomeric body rests. The guide through-hole is shown as having a diameter "H". The width "B" is formed from a width "G" and a width "F."

Turning now to the front view, the dimension "A" is shown as being formed from the dimensions "D," "E," "J," "K," and "I." The dimension "D" is the dimension for the area that supports the guide through-hole. The dimension "E" is the dimension between the outermost circumference of the 1$^{st}$ arc plate 1500 and the curved support member. The dimension "J" is the dimension or thickness of the curved support member. The dimension "K" is the dimension spanning the region from the innermost circumference of the 1$^{st}$ arc plate to the point where the curved support member begins. The dimension "I" is the dimension of the half circle formed by the curved support member.

As will be seen in later Figures, the dimensions "D," "J," and "K" are uniform even between the different arc plates. In this figure, the dimension "L" is formed from the dimensions "E," "J," and "K" while the dimension "M" is formed from "L" plus the dimension "D."

The height of the section supporting the guide through-hole is labeled as having a height "N." FIG. 15 also lists various curvature radii, including curvature radius 1505. Specifically, the outermost radius of the arc plate is the dimensions "(C+E+E)/2." The radius of the outermost portion of the curved support member is "C/2." The radius of the innermost portion of the curved support member is "O" (also (C−J)/2). The radius of the innermost portion of the 1$^{st}$ arc plate 1500 is "P" (also (C−J−K)).

The connector holes also are shown as having dimensions. Specifically, the outer diameter (OD) of the connector hole is "Q" while the inner diameter (ID) is shown as being "R."

The dimension "A" is often (though not necessarily) between about 310 mm and about 320 mm, and is often about 313.5 mm or about 343.5 mm. The dimension "B" is often between about 31 mm and 40 mm, and is often about 31.75 mm. The dimension "C" is between about 260 mm and 270 mm, and is often about 261.3 mm. The dimension "D" is often between about 20 mm and 30 mm, and is often about 23.4 mm. The dimension "E" is often between about 2 mm and 5 mm, and is often about 2.7 mm. In some instances, the dimension "E" is less than 2 mm, such as between 0.5 mm and 2.0 mm. The dimension "F" is often between about 15 mm and 25 mm, and is often about 19.05 mm. The dimension "G" is often between about 10 mm and 20 mm, and is often about 12.7 mm. The dimension "H" is often between about 10 mm and 20 mm, and is often about 14.7 mm. The dimension "I" is often between about 220 mm and 230 mm, and is often about 228.6 mm. The dimension "J" is often between about 1 mm and 10 mm, and is often about 6.35 mm. The dimension "K" is often between about 5 mm and 15 mm, and is often about 10 mm. The dimension "L" is often between about 15 mm and 25 mm, and is often about 19.05 mm. The dimension "M" is often between about 40 mm and 50 mm, and is often about 42.45 mm. The dimension "N" is often between about 35 mm and 45 mm, and is often about 40.64 mm. The dimension "O" is often between about 120 mm and 130 mm, and is often about 124.3 mm. The dimension "P" is often between about 110 mm and 120 mm, and is often about 114.3 mm. The dimension "Q" is often between about 5 mm and 15 mm, and is often about 10 mm. The dimension "R" is often between about 5 mm and 15 mm, and is often about 7 mm. Of course, these dimensions are for example purposes only and should not be construed as being binding. Even the ranges are for example purposes only and should not be construed as binding.

Figure 16:
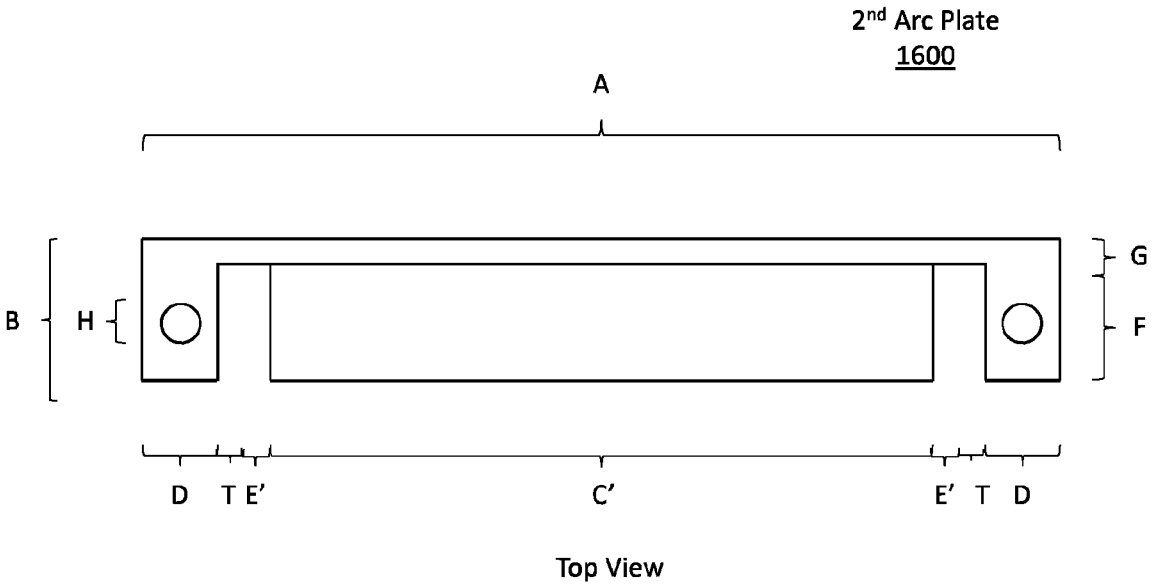
FIG. 16 illustrates a top and side perspective views of the $2^{nd}$ arc plate, along with its dimensions.
Figure 16:
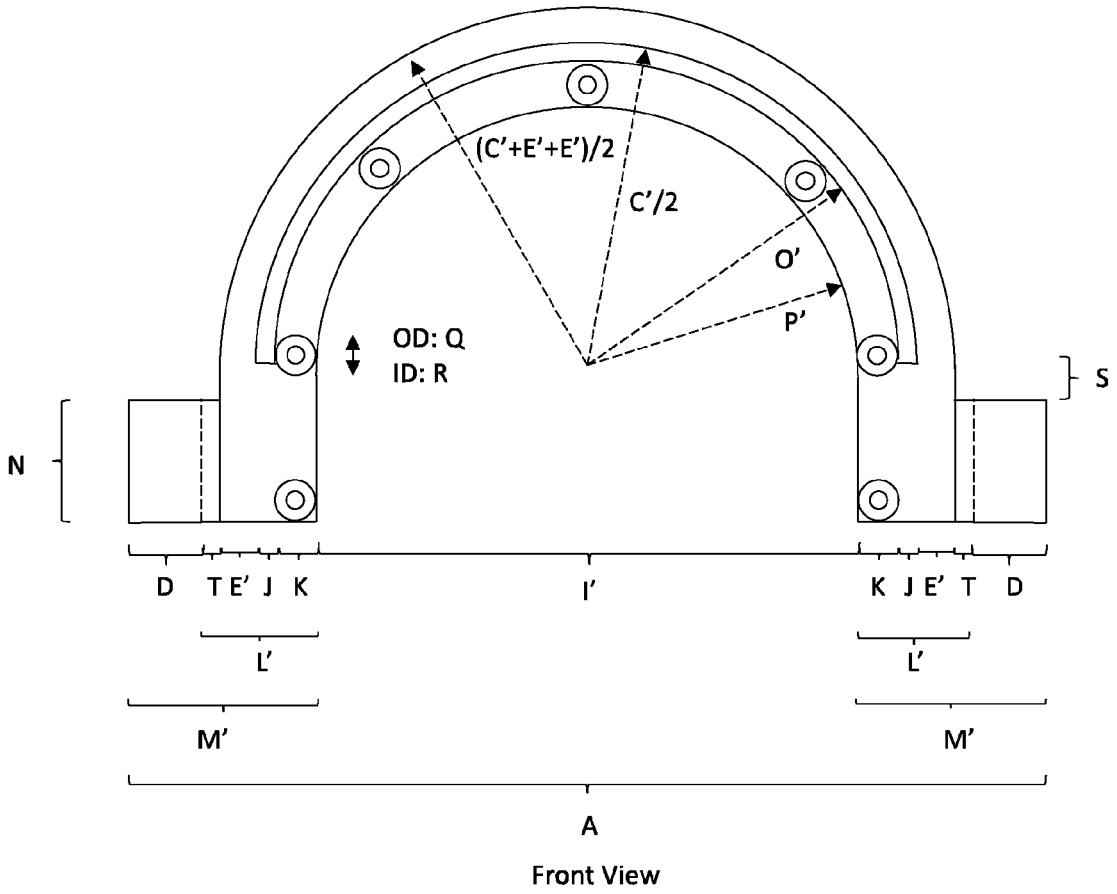

FIG. 16 shows a top view of the 2$^{nd}$ arc plate 1600. The length of the 2$^{nd}$ arc plate 1600 is shown as being dimension "A" (same as that of the 1$^{st}$ arc plate) and the width is shown as being dimension "B" (again the same as the 1$^{st}$ arc plate). Dimensional letters that are common between the figures means that the dimensions are the same. For example, the dimension "A" in FIG. 15 is the same as the dimension "A" in FIG. 15. On the contrary, dimension "C" is different than dimension "C'."

The length of the 2$^{nd}$ arc plate 1600 is shown as having a section "D" for the guide through-holes. A new dimension is introduced, as shown by new dimension "T." Dimension "T" shows how the gap through which the elastomeric body fits is now larger than the gap shown in FIG. 15. The gap is larger so the various arc plates can be nested within one another. The gap is now formed by the dimension "T" plus the dimension "E'," which is larger than the dimension "E." The dimension "C" is also shown and represents the area where the elastomeric body rests. The guide through-hole is shown as having a diameter "H". The width "B" is formed from a width "G" and a width "F."

Turning now to the front view, the dimension "A" is shown as being formed from the dimensions "D," "T," "E'," "J," "K," and "I'." The dimension "D" is the dimension for the area that supports the guide through-hole. The dimension "T" represents the increase in size for the gap mentioned earlier. The dimension "E'" is the dimension between the outermost circumference of the 2$^{nd}$ arc plate 1600 and the curved support member. The dimension "J" is the dimension or thickness of the curved support member. The dimension "K" is the dimension spanning the region from the innermost circumference of the 2$^{nd}$ arc plate to the point where the curved support member begins. The dimension "I'" is the diameter of the half circle formed by the curved support member. The dimension "I'" is smaller than the dimension "I."

In this figure, the dimension "L'" is formed from the dimensions "T," "E'," "J," and "K" while the dimension "M'" is formed from "L'" plus the dimension "D."

The height of the section supporting the guide through-hole is labeled as having a height "N." A new dimension "S" is also now introduced. The dimension "S" shows how an additional length has been added between the area where the half circle terminates and where the section supporting the guide through-hole begins.

FIG. 16 also lists various curvature radii. Specifically, the outermost radius of the arc plate is the dimensions "(C'+E'+E')/2." The radius of the outermost portion of the curved support member is "C'/2." The radius of the innermost portion of the curved support member is "O'." The radius of the innermost portion of the $2^{nd}$ arc plate 1600 is "P'."

The connector holes also are shown as having dimensions. Specifically, the outer diameter (OD) of the connector hole is "Q" while the inner diameter (ID) is shown as being "R."

The new dimension "C'" is often between about 205 mm and 215 mm, and is often about 210.5 mm. The dimension "E'" is often between about 5 mm and 15 mm, and is often about 9.05 mm, which is larger than the previous dimension "E." The dimension "I'" is often between about 175 mm and 185 mm, and is often about 177.8 mm. The dimension "L'" is often between about 40 mm and 50 mm, and is often about 44.45 mm. The dimension "M'" is often between about 60 mm and 70 mm, and is often about 67.85 mm. The dimension "O'" is often between about 90 mm and 100 mm, and is often about 98.9 mm. The dimension "P'" is often between about 80 mm and 90 mm, and is often about 88.9 mm. The dimension "S" is often between about 35 mm and 45 mm, and is often about 40.64 mm. The dimension "T" is often between about 15 mm and 25 mm, and is often about 19.05 mm.

Figure 17:
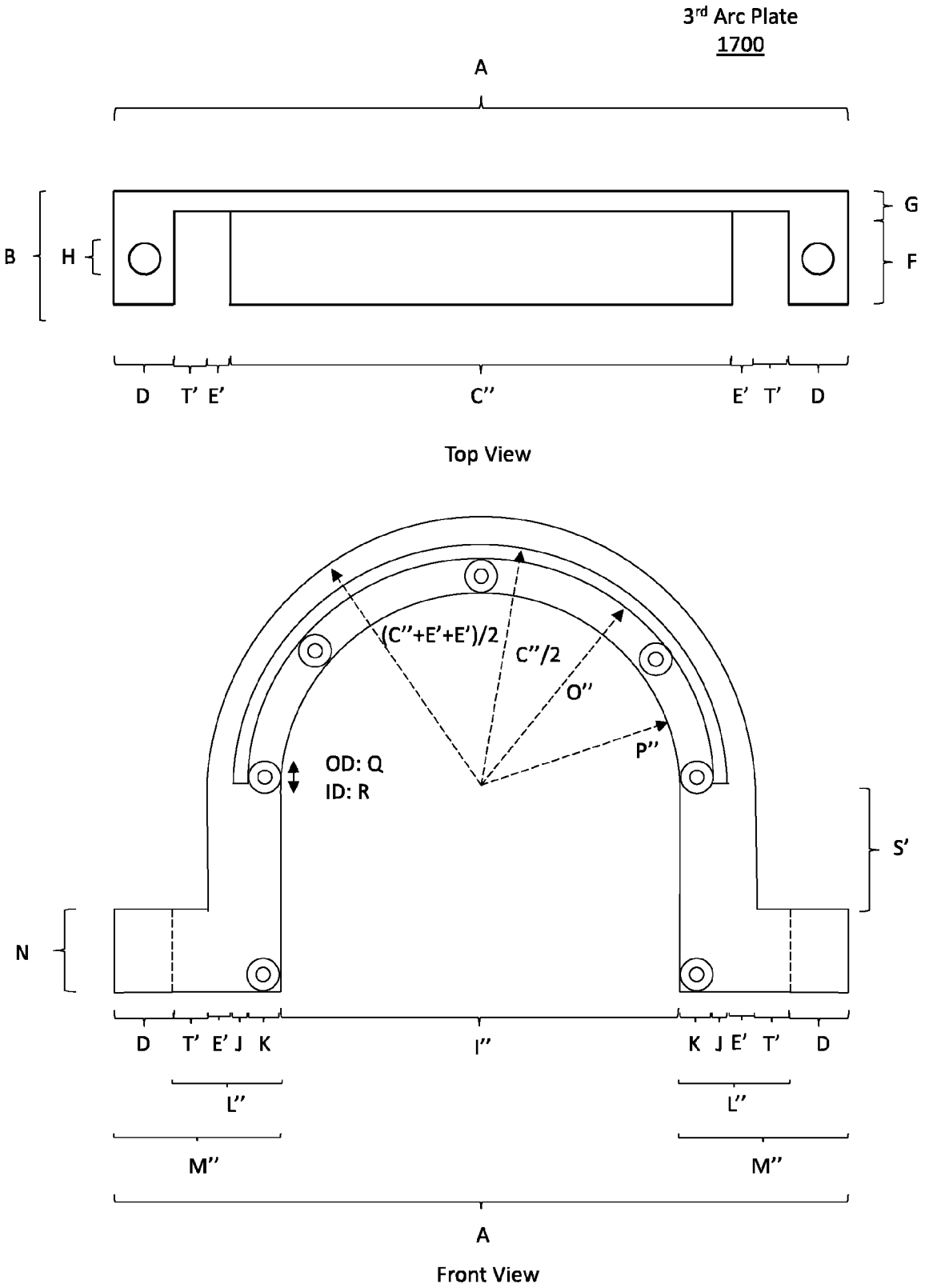
FIG. 17 illustrates a top and side perspective views of the $3^{rd}$ arc plate, along with its dimensions.

FIG. 17 shows the various dimensions for the $3^{rd}$ arc plate 1700. The new dimension "C'''" is often between about 150 mm and 160 mm, and is often about 159.7 mm. The dimension "I'''" is often between about 120 mm and 130 mm, and is often about 127.0 mm. The dimension "L'''" is often between about 65 mm and 75 mm, and is often about 69.95 mm. The dimension "M'''" is often between about 90 mm and 100 mm, and is often about 93.35 mm. The dimension "O'''" is often between about 70 mm and 80 mm, and is often about 73.5 mm. The dimension "P'''" is often between about 60 mm and 70 mm, and is often about 63.5 mm. The dimension "S'''" is often between about 75 mm and 85 mm, and is often about 81.28 mm. The dimension "T'" is often between about 40 mm and 50 mm, and is often about 44.55 mm.

Figure 18:
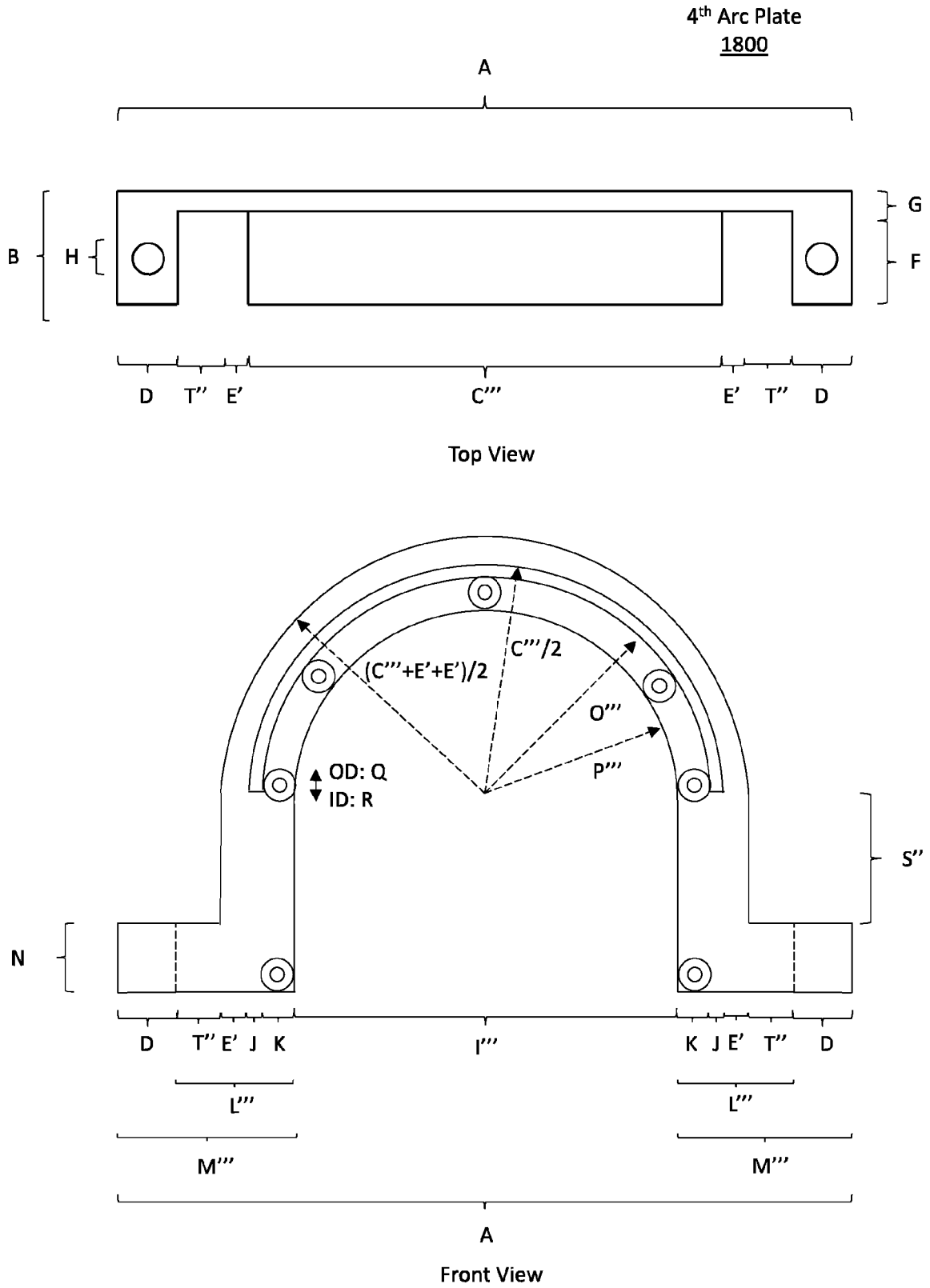
FIG. 18 illustrates a top and side perspective views of the $4^{th}$ arc plate, along with its dimensions.

FIG. 18 shows the various dimensions for the $4^{th}$ arc plate 1800. The new dimension "C''''" is often between about 105 mm and 115 mm, and is often about 108.9 mm. The dimension "I''''" is often between about 70 mm and 80 mm, and is often about 76.2 mm. The dimension "L''''" is often between about 90 mm and 100 mm, and is often about 95.25 mm. The dimension "M''''" is often between about 115 mm and 125 mm, and is often about 118.65 mm. The dimension "O''''" is often between about 45 mm and 55 mm, and is often about 48.0 mm. The dimension "P''''" is often between about 35 mm and 45 mm, and is often about 38.0 mm. The dimension "S''''" is often between about 115 mm and 125 mm, and is often about 121.92 mm. The dimension "T''''" is often between about 65 mm and 75 mm, and is often about 69.85 mm.

Figure 19:
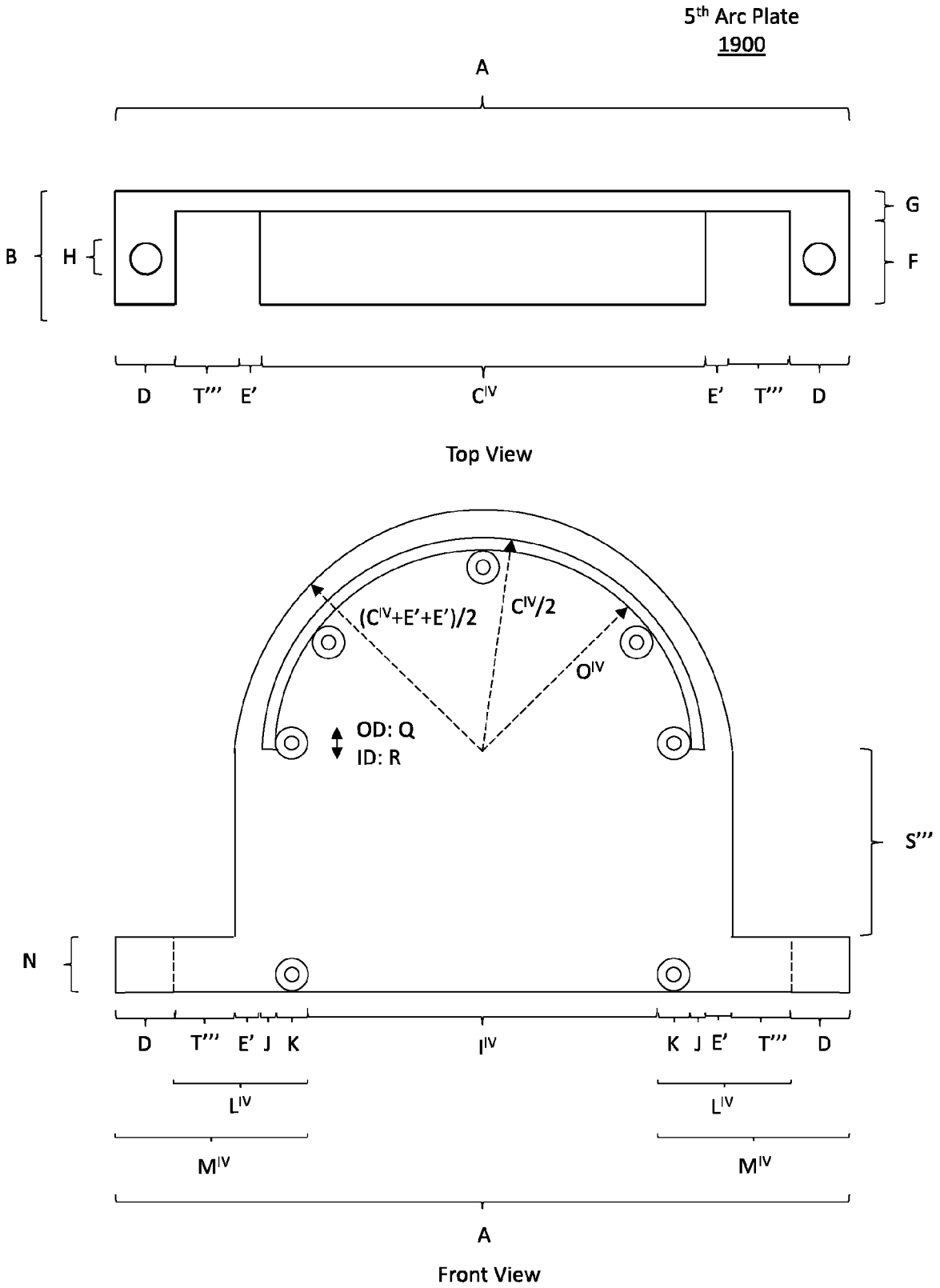
FIG. 19 illustrates a top and side perspective views of the $5^{th}$ arc plate, along with its dimensions.

FIG. 19 shows the various dimensions for the $5^{th}$ arc plate 1900. The new dimension "$C^{IV}$" is often between about 55 mm and 65 mm, and is often about 58.1 mm. The dimension "$I^{IV}$" is often between about 20 mm and 30 mm, and is often about 25.4 mm. The dimension "$L^{IV}$" is often between about 115 mm and 125 mm, and is often about 120.65 mm. The dimension "$M^{IV}$" is often between about 140 mm and 150 mm, and is often about 144.05 mm. The dimension "$O^{IV}$" is often between about 20 mm and 30 mm, and is often about 22.7 mm. The dimension "S''''" is often between about 160 mm and 170 mm, and is often about 162.56 mm. The dimension "T''''" is often between about 90 mm and 100 mm, and is often about 95.25 mm. Of course, all of these dimensions are for example purposes only, and they should not be construed as being limiting or binding.

In some embodiments, the dimension "N" for the $1^{st}$ arc plate is two the dimension "N" for the other arc plates. Such is the case in order to provide additional reinforcement for that arc plate.

Figure 20:
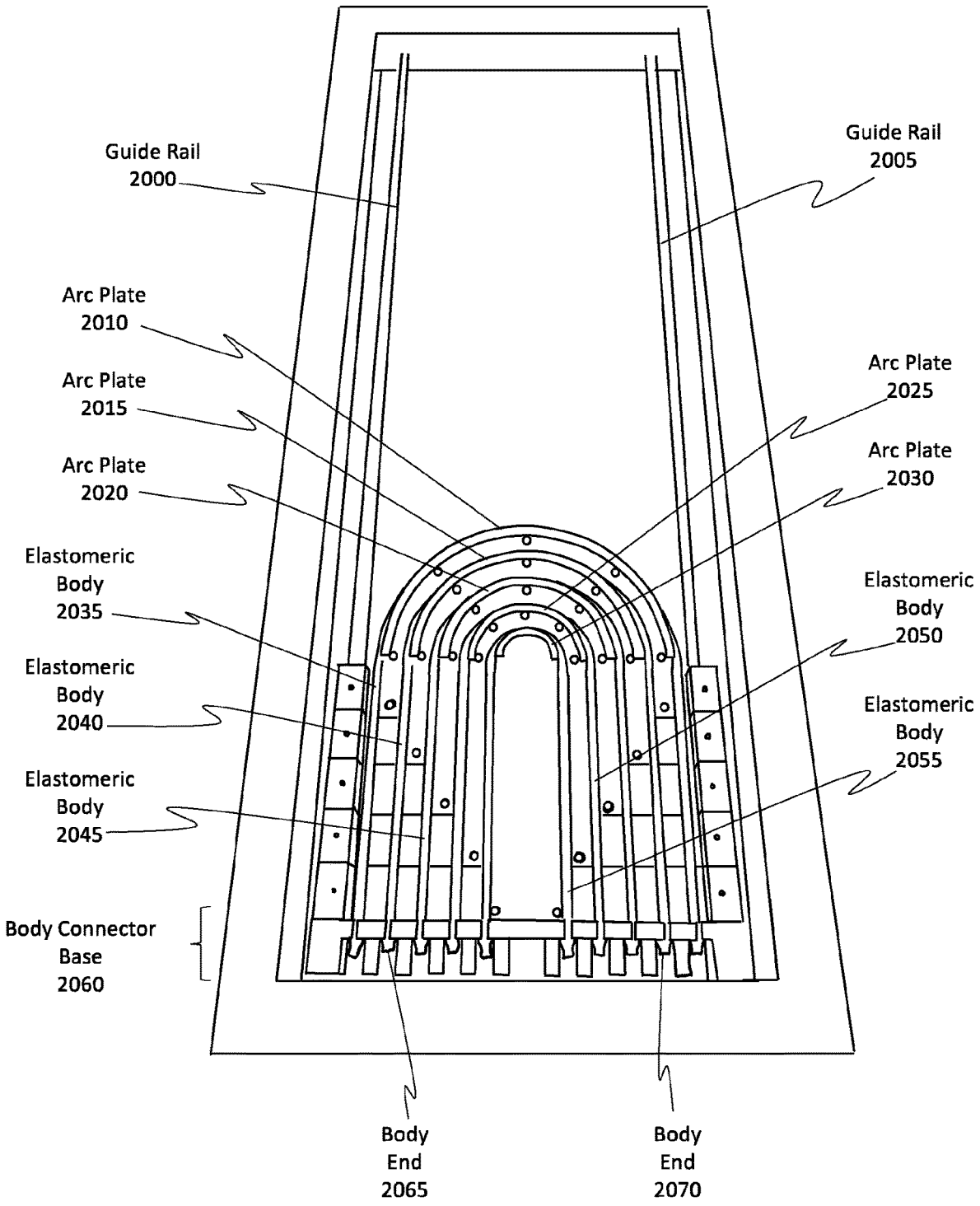
FIG. 20 illustrates a view of the arc plates with the frontend covers removed, thereby revealing how the elastomeric bodies are positioned and are secured in place.

FIG. 20 shows another view of the improved design. Specifically, FIG. 20 shows a set of guide rails 2000, 2005. In this example, the design includes two guide rails. In some implementations, the design includes 1, 2, 3, or perhaps even 4 guide rails. To illustrate, in some embodiments, a single guide rail is positioned on a backend area of the exercise machine and runs along the central area of the exercise machine (e.g., in the middle between the left and right sides). In some implementations, the exercise machine includes 2 guide rails, as shown by FIG. 20. In some implementations, the exercise machine includes 3 guide rails, with two positioned as shown in FIG. 20 and the third positioned on the backend as described above.

Accordingly, in some embodiments, the exercise machine includes a left guide rail and a right guide rail. The arc plate(s) may include a left guide through-hole and a right guide through-hole. The left guide rail extends through the left guide through-hole of the arc plate, and the right guide rail extends through the right guide through-hole. Consequently, the arc plate is free to move in a movement direction, which is defined by the left guide rail and the right guide rail.

FIG. 20 also shows various arc plates, including arc plates 2010, 2015, 2020, 2025, and 2030. FIG. 20 further shows various elastomeric bodies, including elastomeric bodies 2035, 2040, 2045, 2050, and 2055. The arc plate 2010 is the so-called "$1^{st}$ arc plate" and the elastomeric the 2035 is the body for that $1^{st}$ arc plate. The arc plate 2015 is the so-called "$2^{nd}$ arc plate" and the elastomeric body 2040 is the body for that $2^{nd}$ arc plate. The arc plate 2020 is the so-called "$3^{rd}$ arc plate" and the elastomeric body 2045 is the body for that $3^{rd}$ arc plate. The arc plate 2025 is the so-called "$4^{th}$ arc plate" and the elastomeric body 2050 is the body for that $4^{th}$ arc plate. The arc plate 2030 is the so-called "$5^{th}$ arc plate" and the elastomeric body 2055 is the body for that $5^{th}$ arc plate. Notice, the various elastomeric bodies wrap around (at least partially) the curved or "arc" portion of the different arc plates.

Figure 21:
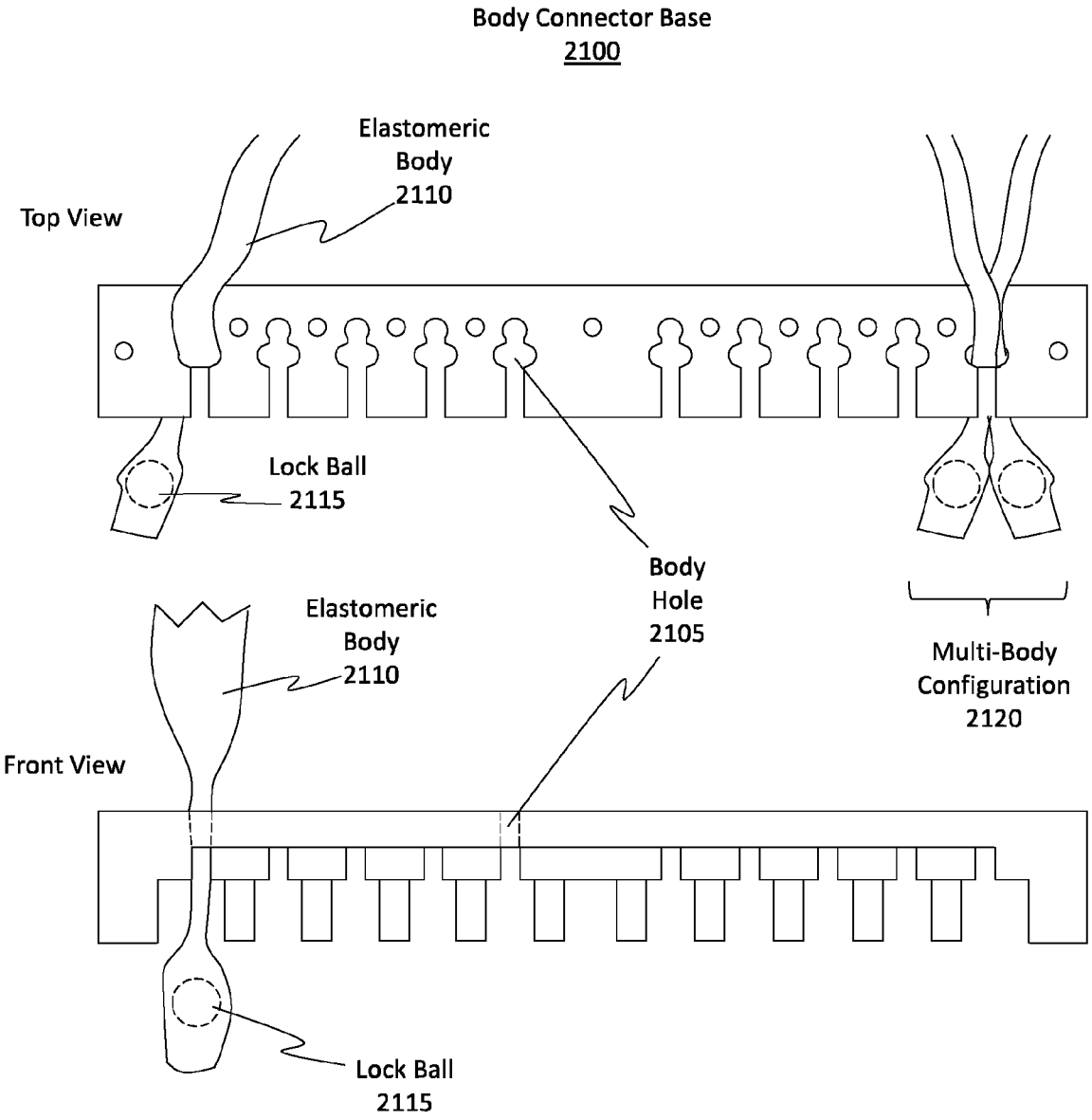
FIG. 21 illustrates an example of a so-called body connector base, which may be used to secure the elastomeric bodies to a non-moving member so the elastic resistance can be formed.

In this example scenario, each of the elastomeric bodies includes two terminating ends. Other embodiments, however, may not have terminating ends for the elastomeric bodies. Such embodiments will be discussed in more detail later. In any event, the two terminating ends of each elastomeric body are shown as being connected or coupled to the body connector base 2060. For example, the elastomeric body 2040 includes a body end 2065 and a body end 2070. Both of those body ends are secure in place using the body connector base 2060. FIG. 21 provides additional details.

FIG. 21 shows a body connector base 2100 (also called a "locking plate"), which is representative of the body connector base 2060 of FIG. 20. FIG. 21 shows both a top view of the body connector base 2100 and a front view. That is, the elastomeric body may be coupled to a body connector base that is connected to the frame.

Regarding the top view, the body connector base 2100 includes multiple body holes, such as body hole 2105. An elastomeric body, such as elastomeric body 2110, is configured to fit within the body hole 2105. In some implementations, more than one elastomeric body can fit within the body hole 2106 such that each body hole can accommodate multiple (e.g., 2, 3, 4, 5, 6, or more) elastomeric bodies. In order to lock or secure the elastomeric body 2110 in place, some embodiments use a locking mechanism to prevent the elastomeric body 2110 from slipping or dislodging from the body hole. For example, in this scenario, the elastomeric body 2110 may be configured as a tube body, and a lock ball 2115 (e.g., a 10 mm BB ball or some other sized ball or plastic ball) can be inserted into the terminal end of the elastomeric body 2110. The lock ball 2115 prevents the elastomeric body 2110 from being released from the body hole. A pinching device or clamp or any type of tie-down may also be used to lock the body in place.

The number of body holes corresponds to the number of elastomeric bodies and the number of arc plates that are incorporated into the exercise machine. For example, if the exercise machine includes only a single arc plate and elastomeric body combination, then it may be the case that only a single body hole is provided. If 2, 3, 4, 5, or more than 5 arc plate/elastomeric bodies are used, then a corresponding 2, 3, 4, 5, or more than 5 body holes may be provided. In some cases, 2 or more bodies may use the same body hole, such as when a single arc plate supports multiple bodies.

Optionally, the location of the body hole is horizontally in-line with the terminal end portion of the curved support member. For instance, with reference to FIG. 20, the location of any of the body holes is in-line (horizontally) with the location where the arc region, or rather the curved support member, ends, such that the body is vertically straight from the point where it exits the curved support member to the point where it enters the body hole. In some embodiments, the body hole may have a horizontal offset relative to the terminal end of the curved support member such that the body is angled inward or outward.

Returning to FIG. 21, the front view of the body connector base 2100 again shows how the elastomeric body 2110 is able to fit within a body hole. Similarly, the lock ball 2115 is inserted into the tube to prevent the elastomeric body 2110 from being released. Of course, other locking mechanisms may be used. Examples include, but are not limited to, any type of clamp, clasp, knot, tie-down, and so forth.

Referring to the top view, the length of the body connector base 2100 is often between about 300 and 330 mm, and is often about 313.5 mm or about 343.5 mm. The width is often between about 20 mm and 50 mm, and is often about 38.1 mm. The spacing between one body hole and another is often between about 5 mm and 20 mm, and is often around 12.7 mm. The width of a body hole is often between about 1 mm and 10 mm, and is often about 3.18 mm.

FIG. 21 also shows a multi-body configuration 2120. With this configuration, multiple elastomeric bodies are inserted into the same body hole. For instance, it may be the case that each arc plate supports 2 (or 3, 4, 5, 6, or more) elastomeric bodies. Those 2 elastomeric bodies can use the same body hole in order to be connected or secured to the body connector base 2100. For instance, the multi-body configuration 2120 shows a scenario where two different elastomeric bodies are using the same body hole to be secured to the body connector base 2100.

Figure 22:
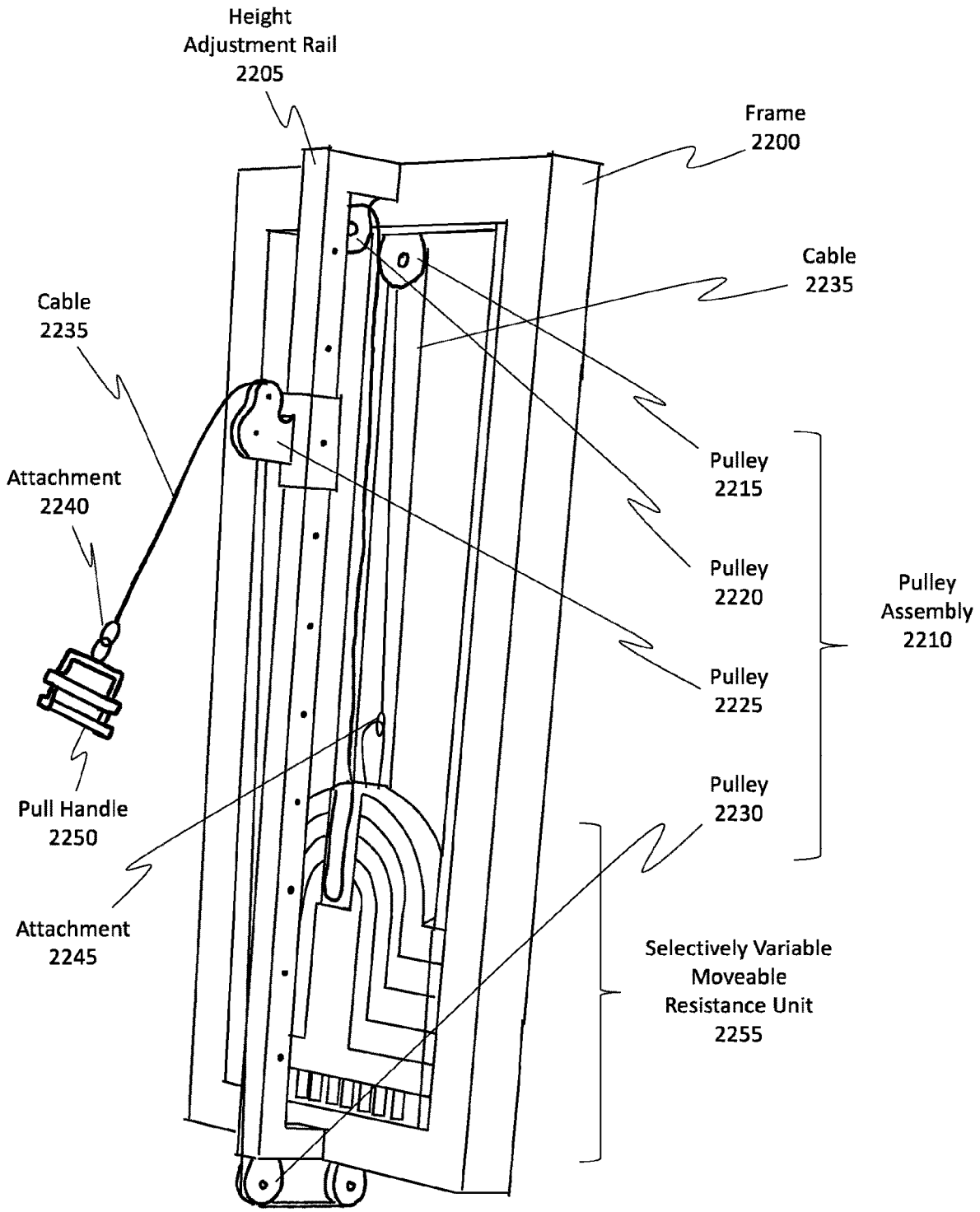
FIG. 22 illustrates a side-angled view of the exercise machine.

FIG. 22 shows another angle or viewpoint of the improved exercise machine design and also shows a single handle configuration. Specifically, the exercise machine includes a frame 220, a height adjustment rail 2205, a pulley assembly 2210 supported by the frame 2200. The pulley assembly 2210 may include any number of pulleys, such as pulleys 2215, 2220, 2225, and 2230. While four pulleys are labeled, the embodiments may include 1, 2, 3, 4, 5, 6, 7, 8, 9, 10, or even more than 10 pulleys.

The exercise machine also includes a cable 2235 extending through the pulley assembly 2210. The cable 2235 has attachments at its opposite ends, including a first attachment 2240 and a second attachment 2245. The first attachment 2240 is structured to connect to a pull handle 2250, and the second attachment 2245 is potentially structured to connect to the selectively variable moveable resistance unit 2255. In some cases, the second attachment 2245 is connected to the height adjuster mentioned earlier. In any event, the cable 2235 is either directly or indirectly connected to the selectively variable moveable resistance unit 2255. For instance, the cable 2235 may be directly connected to the selectively variable moveable resistance unit 2255 when the second attachment 2245 is coupled to the selectively variable moveable resistance unit 225, such as in the case of a single handle configuration. The cable 2235 may be indirectly connected to the selectively variable moveable resistance unit 2255 when the cable extends through a pulley connected to the selectively variable moveable resistance unit 2255, such as in the case of a dual handle configuration.

The selectively variable moveable resistance unit 2255 is structured to provide an elastic resistance when a pulling force is applied to the connected pull handle 2250. Additionally, the unit 2255 is connected to the cable 2235.

As discussed previously, the unit 2255 comprises an elastomeric body (or multiple bodies) that provides the elastic resistance and an arc plate (or multiple arc plates). The arc plate provides a curved support member on which a portion of the elastomeric body at least partially wraps around. Movement of the arc plate, which movement is caused by the pulling force applied to the pull handle 2250, causes the elastomeric body to stretch and to provide the elastic resistance.

In some embodiments, the unit 2255 includes multiple elastomeric bodies and multiple arc plates. By way of example, the unit 2255 may include a first elastomeric body (e.g., perhaps elastomeric body 2035 from FIG. 20) and a first arc plate (e.g., arc plate 2010 from FIG. 20). The first arc plate provides a first curved support member (e.g., curved support member 825 from FIG. 8) on which a portion of the first elastomeric body at least partially wraps around.

The unit 2255 may include a second elastomeric body (e.g., elastomeric body 2040 from FIG. 20) and a second arc plate (e.g., arc plate 2015 from FIG. 20). The second arc plate provides a second curved support member (e.g., curved support member 830 from FIG. 8) on which a portion of the second elastomeric body at least partially wraps around.

The unit 2255 may further include a selection unit (e.g., selection unit 600 from FIG. 6) for enabling different selection settings of the selectively variable moveable resistance unit 2255. The different selection settings causes the first elastomeric body or a combination of at least the first elastomeric body and the second elastomeric body (or combinations of the first, second, and perhaps even third, fourth, or fifth bodies) to provide the selectively variable elastic resistance. The movement of the first arc plate and/or the second arc plate (and/or the other arc plates), which movement is caused by the pulling force applied to the pull handle 2250, causes the first elastomeric body and/or the second elastomeric body (and/or the other bodies) to stretch and to provide the elastic resistance.

Optionally, the exercise machine may include one or more guide rails (e.g., guide rails 410, 415) that are connected to the frame (2200) and that are structured to guide connected members (e.g., the unit 2255) along a movement direction (e.g., movement direction 1220). As will be discussed in more detail later, the guide rails 410, 415 also help ensure that various so-called "arc plates" (to be discussed later) are moved in a manner to ensure proper nesting between the different plates. In this regard, misalignments between the plates is prevented.

The machine can include a height adjustment rail 2205 that is connected to the frame 2200 and that runs parallel to the one or more guide rails. The pulley assembly 2210 is supported by the frame 2200 and includes at least one pulley (e.g., pulley 2225). This pulley 2225 is connected to the height adjustment rail 2205 and is moveable along the height adjustment rail 2205 to accommodate different heights of different exercise movements. One or more of the pulleys may be mounted to the frame.

The selectively variable moveable resistance unit 2255 is operatively connected with the guide rails and is guided in the movement direction by the guide rails when operated. That is, the exercise machine includes one or more guide rails that guide the movement of the arc plate(s) in the movement direction.

The unit 2255 is structured to provide a selectively variable elastic resistance when a pulling force is applied to the connected pull handle 2250. The unit 2255 is connected to the cable 2235. Furthermore, the unit 2255 includes a number of components, such as a plurality of elastomeric bodies that provide the selectively variable elastic resistance when the pulling force is applied to the pull handle. Different selection settings of the selectively variable moveable resistance unit 2255 (e.g., using the selection unit 600 of FIG. 6) causes one or a combination of multiple elastomeric bodies to be engaged to provide the selectively variable elastic resistance. For example, one elastomeric body may be selected. A combination of two elastomeric bodies may be simultaneously selected. A combination of three, four, five, or more than five elastomeric bodies may be simultaneously selected using the selection unit 600.

The unit 2255 also includes a plurality of nested arc plates, as described previously. Each nested arc plate provides a curved support member on which a portion of a corresponding elastomeric body at least partially wraps around. The different selection settings of the selectively variable moveable resistance unit causes one or a combination of multiple nested arc plates to be engaged. Movement of whichever ones of the nested arc plates are engaged causes corresponding elastomeric bodies of whichever ones of the nested arc plates that are engaged to stretch and to provide the selectively variable elastic resistance.

Because the unit 2255 itself has a non-negligible weight to it, the unit 255 further provides a gravimetric resistance. Consequently, both the gravimetric resistance and the elastic resistance are simultaneously provided during the movement of the arc plate(s).

Figure 23:
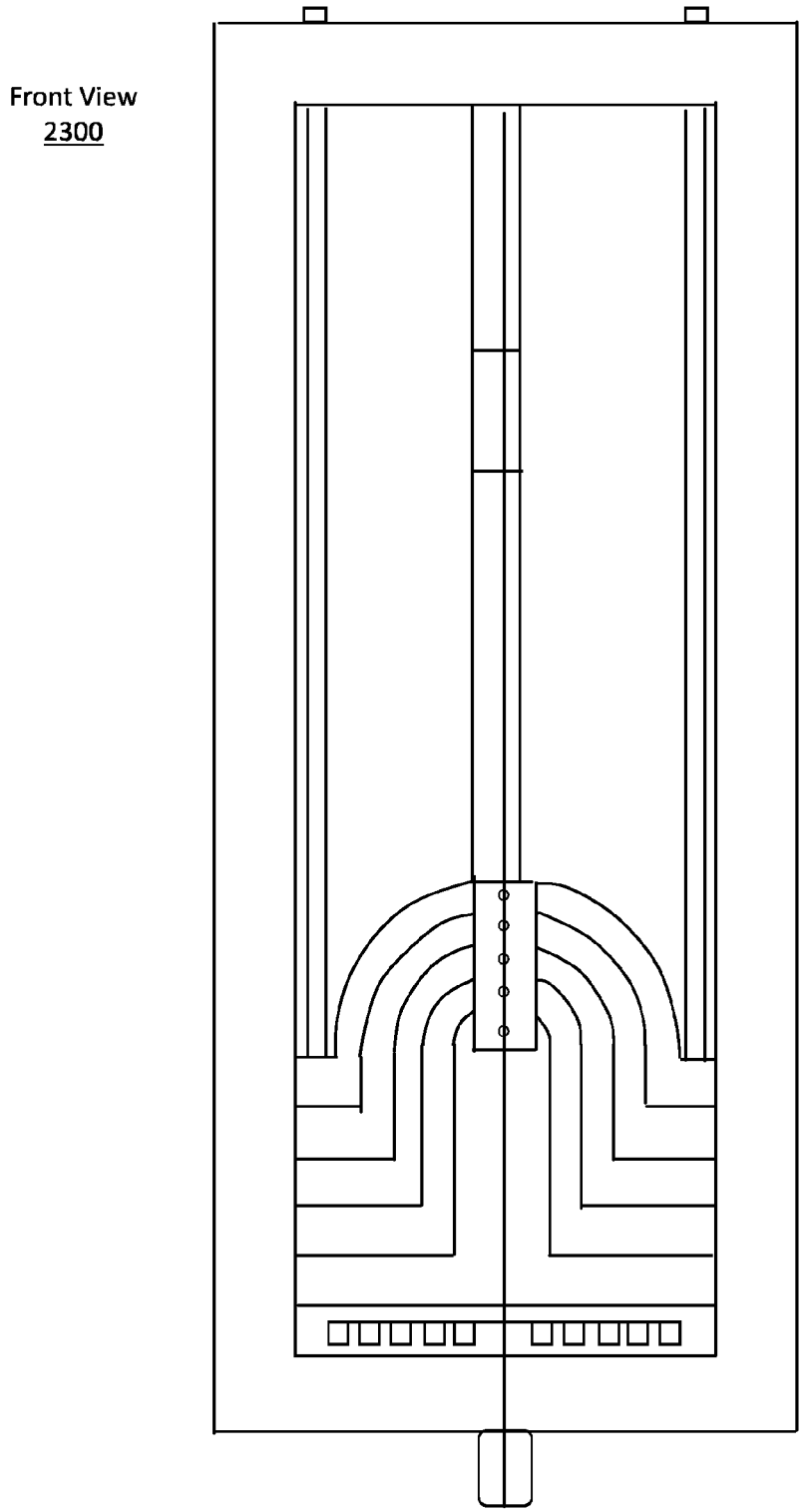
FIG. 23 illustrates a front view of the exercise machine.
Figure 24:
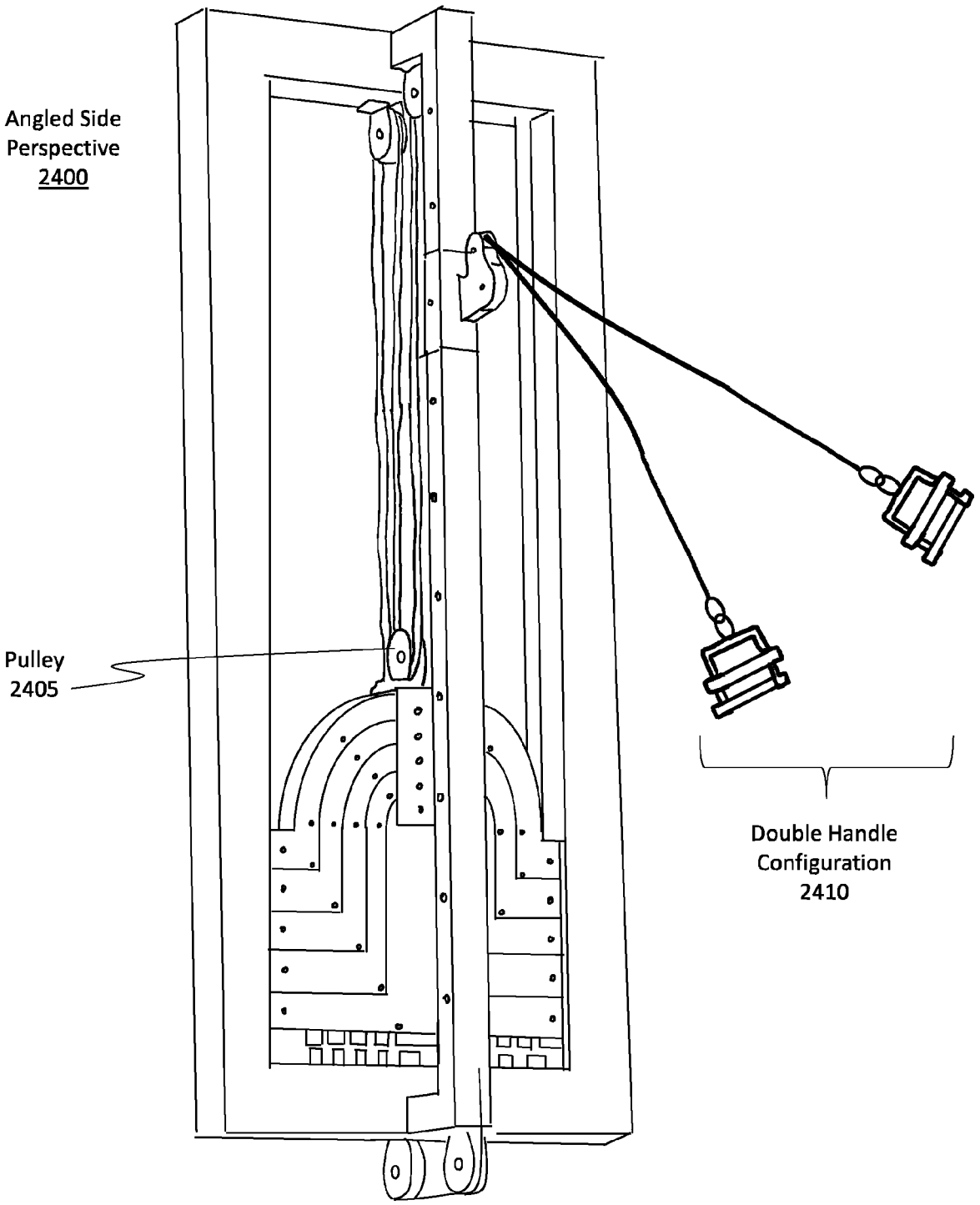
FIG. 24 illustrates another side-angled view of the exercise machine.

FIG. 23 illustrates a front view 2300 of the exercise machine. FIG. 24 illustrates an angled side perspective 2400 of the exercise machine and using a double handle configuration. Specifically, FIG. 24 shows a pulley 2405, which is included in the pulley assembly and which enables the double handle configuration 2410. For single handle systems, the cable can be connected directly to the selectively variable moveable resistance unit. For dual handle systems, the cable(s) terminate at the handles and the cable(s) go through a pulley wheel (e.g., pulley 2405) that is connected to the variable moveable resistance unit. In some embodiments, the cable terminates at the height adjustor unit in order to achieve lower resistance levels and adjustable handle locations.

Figure 25:
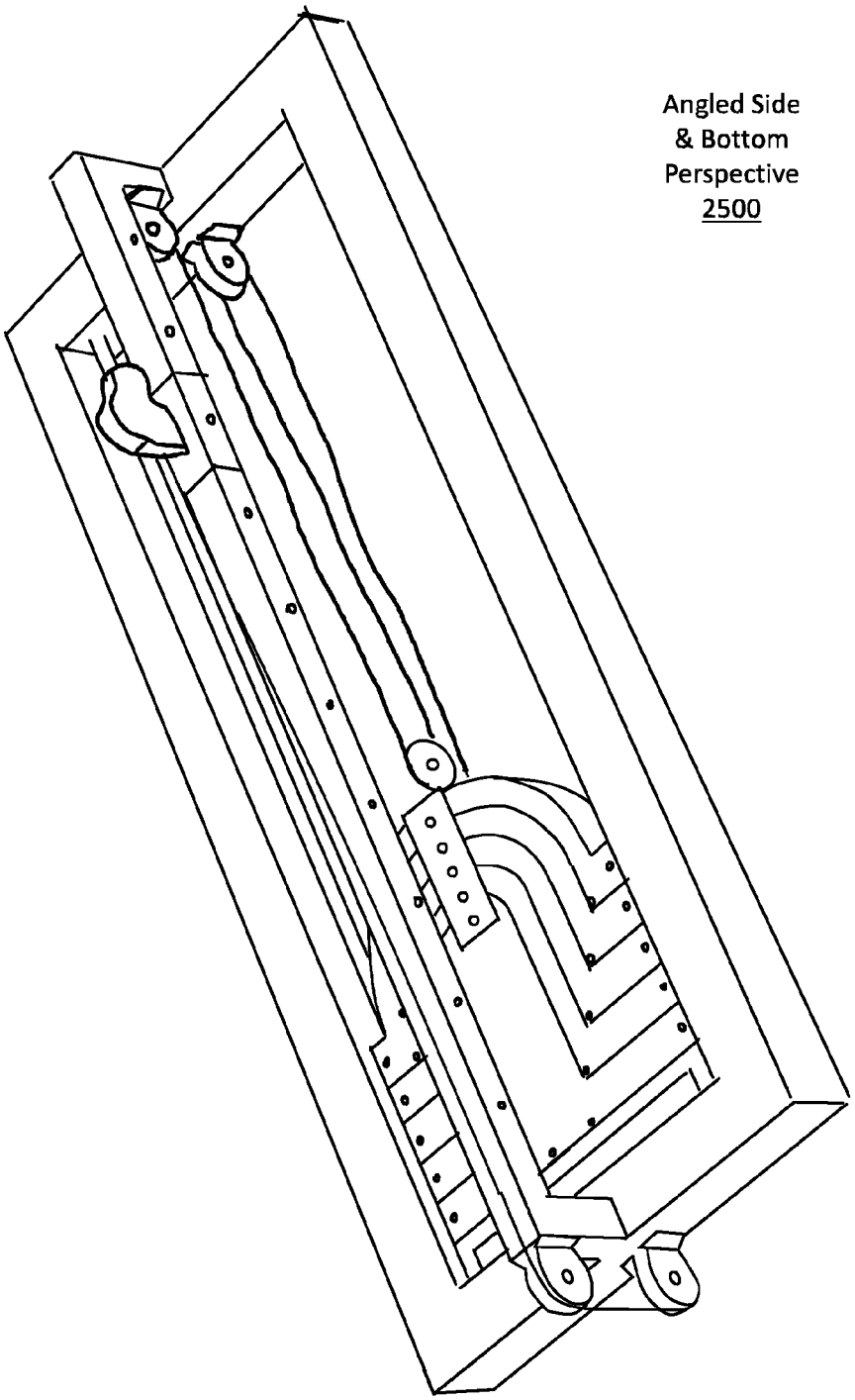
FIG. 25 illustrates a bottom-angled view of the exercise machine.
Figure 26:
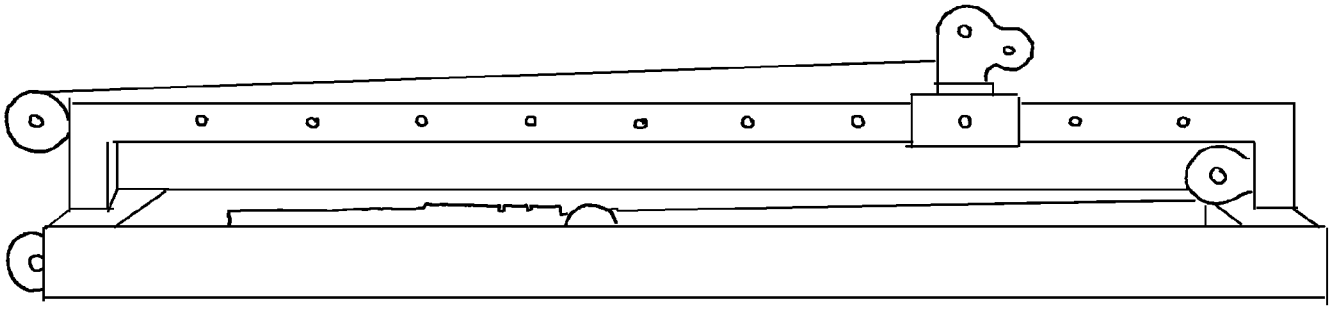
FIG. 26 illustrates a side perspective view of the exercise machine.
Figure 27:
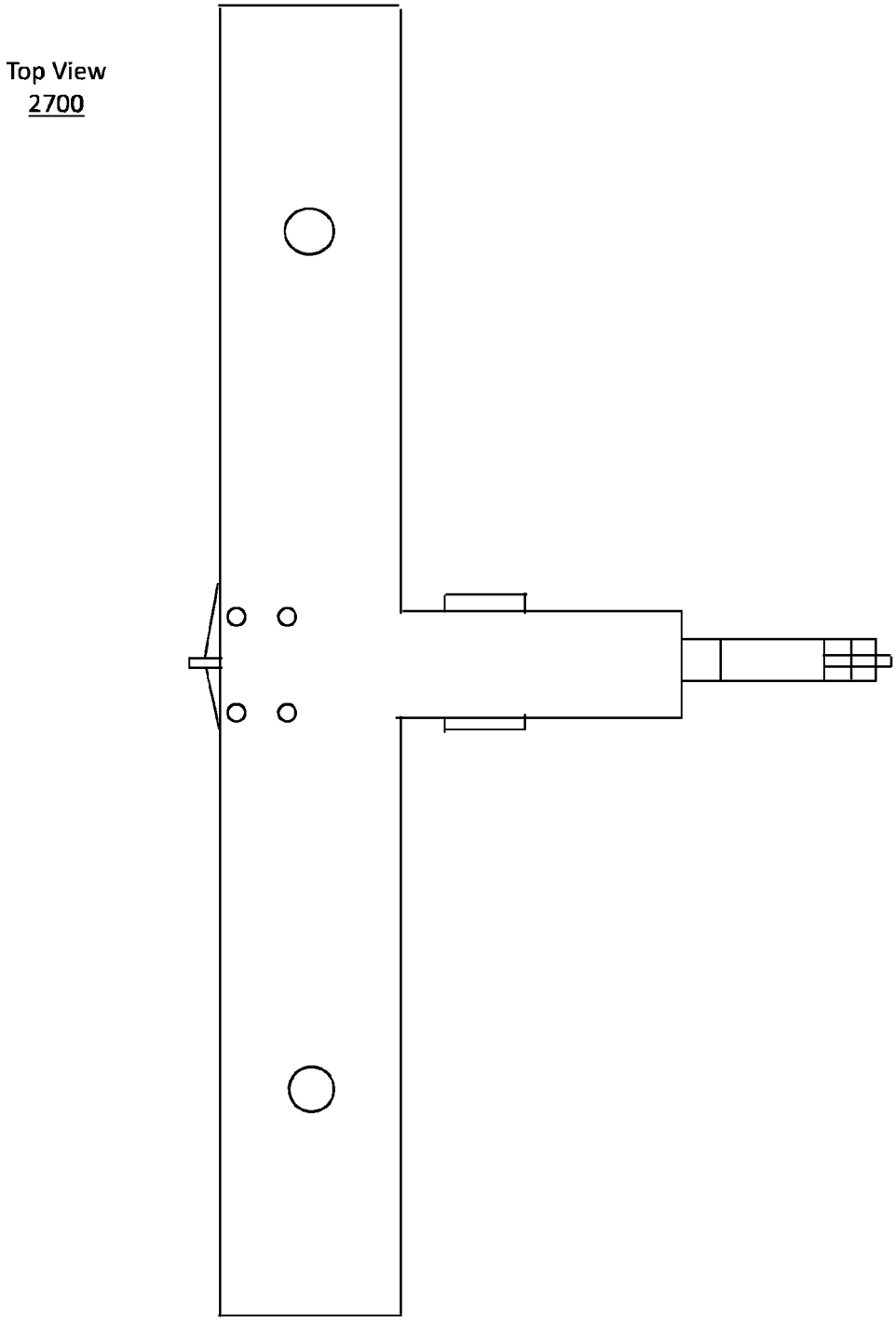
FIG. 27 illustrates a top view of the exercise machine.

FIG. 25 shows an angled side and bottom perspective 2500 of the exercise machine. FIG. 26 shows a side perspective 2600 of the exercise machine. FIG. 27 shows a top view 2700 of the exercise machine.

Figure 28:
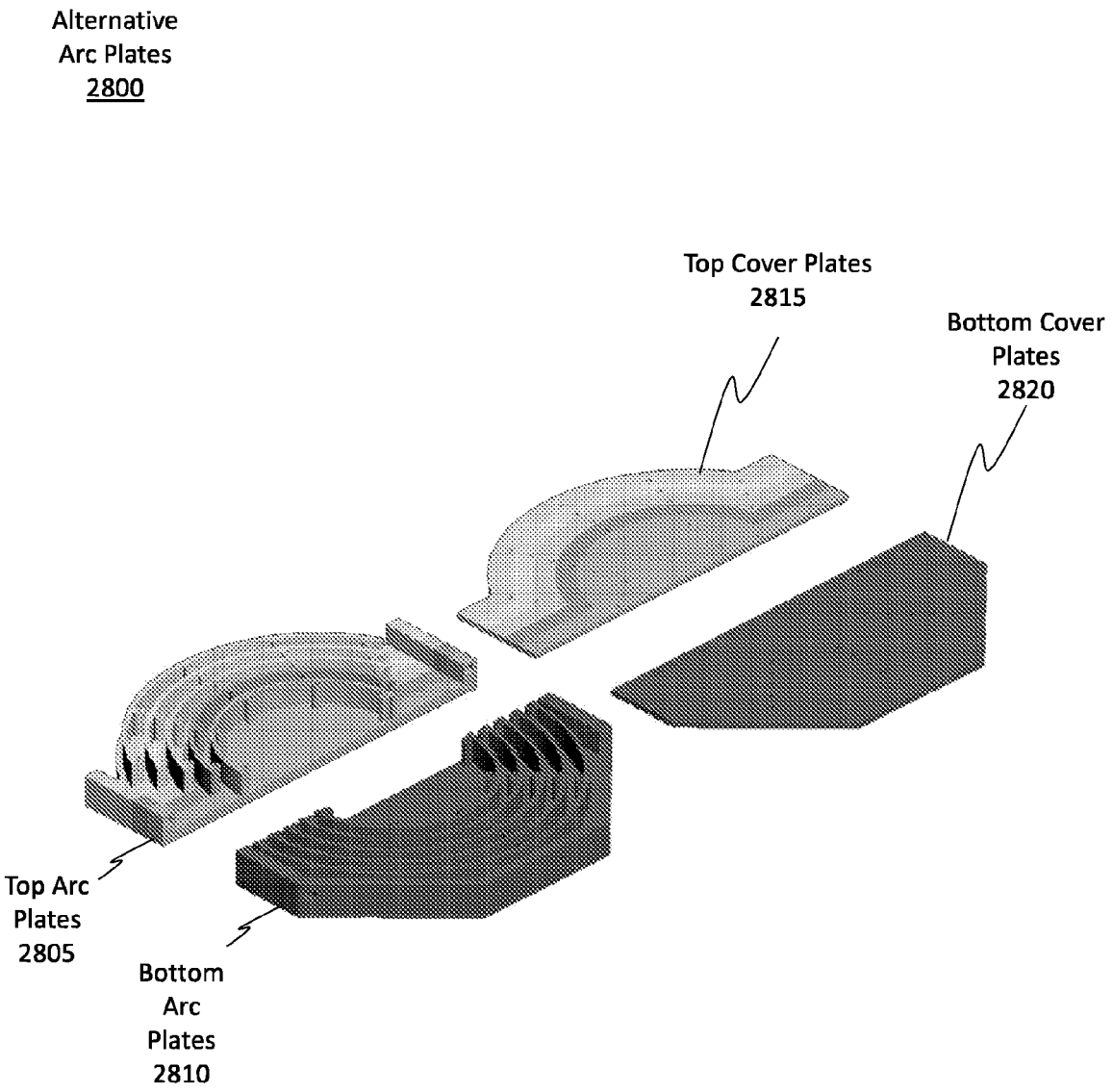
FIG. 28 illustrates another design for the arc plates.

Up to this point, the disclosure has described embodiments where the elastomeric bodies have terminating ends that are secured in place. Some embodiments may use elastomeric bodies that do not have terminating ends but that are loops, such as the one shown in FIG. 3. In such scenarios, the arc plates and/or body connector bases can be modified to accommodate this alternative design. FIG. 28 shows a design for alternative arc plates 2800 structured to accommodate looped elastomeric bodies.

FIG. 28 shows a set of top arc plates 2805 that are structured somewhat similarly to the arc plates 500 of FIG. 5 in that each arc plate includes a curved support member and a member designed to accommodate a guide throughhole. The elastomeric bodies wrap around the curved support members in the same manner as described previously.

FIG. 28 also shows a set of bottom arc plates 2810. The bottom arc plates 2810 include another curved support member around which respective elastomeric bodies wrap around. Instead of supporting a terminal end of an elastomeric body, the bottom arc plates 2810 allow a looped elastomeric body to wrap around this second set of curved support members. FIG. 28 shows a set of top cover plates 2815, which may be secured or fastened to the top arc plates 2805 to cover the elastomeric bodies, and a set of bottom cover plates 2820, which may be secured or fastened to the bottom arc plates 2810 to also cover the elastomeric bodies. Accordingly, some embodiments support a looped design structured to accommodate looped elastomeric bodies.

Figure 29:
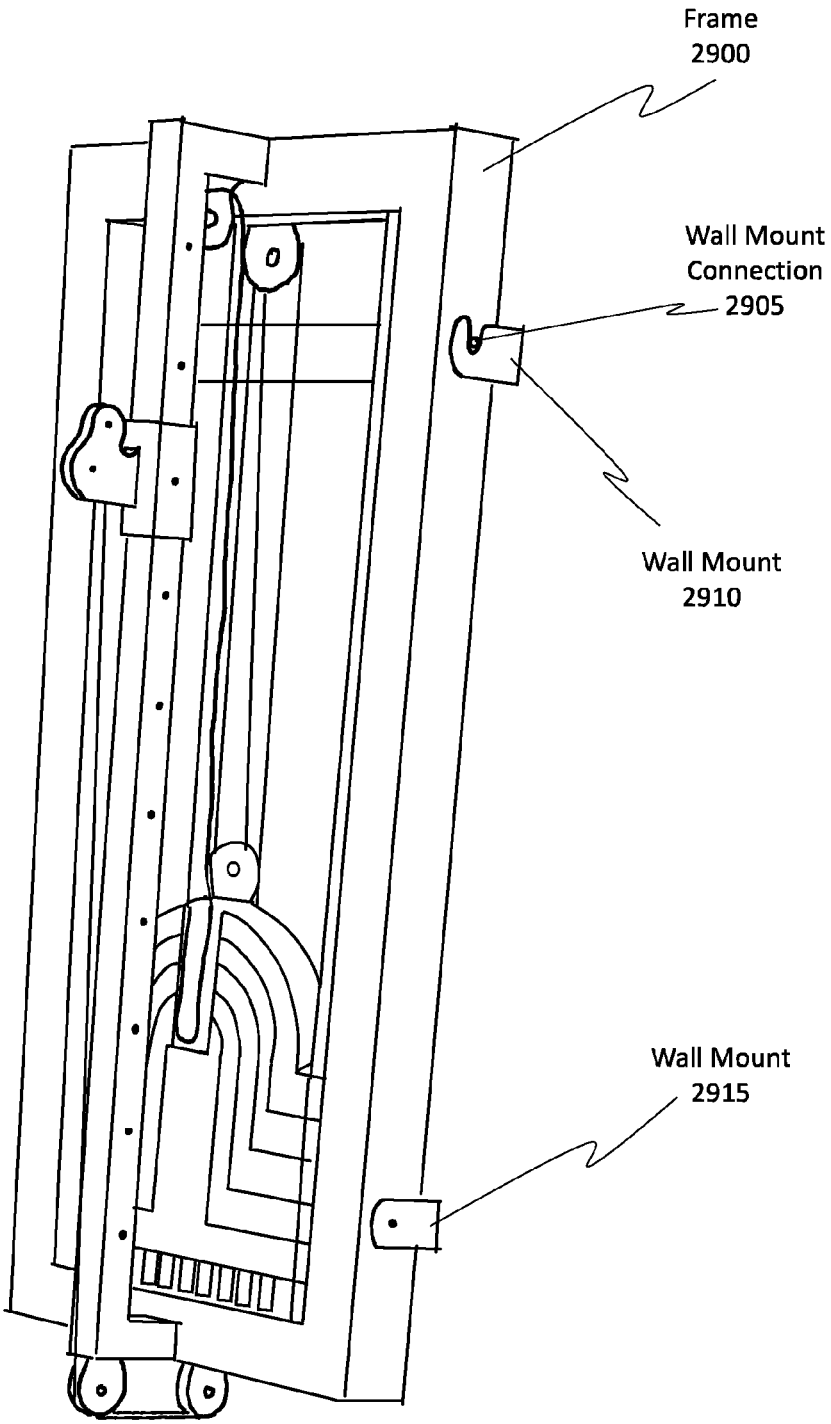
FIG. 29 illustrates various options for structuring the exercise machine so it can be mounted on a wall.

Due to their high weight and large footprint, traditional exercise machines are normally secured in place using ground connection mechanisms, such as floor bolts. Because the disclosed embodiments have a much smaller footprint and a much lighter weight, the disclosed exercise machines can actually be mounted to a wall as opposed to only the floor. That is, in addition to the ability to be mounted to the floor, the disclosed exercise machines also have the option of being wall mounted. FIG. 29 provides a useful illustration.

FIG. 29 shows a frame 2900, which is representative of the frames discussed thus far. Coupled to one side of the frame 2900 is a wall mount connection 2905. Although not illustrated, the other side of the frame 2900 also includes a wall mount connection. In some cases, the wall mount connection 2905 is a protruding member that protrudes outward from the side of the frame 2900 and operates as a connection for a wall mount 2910. The wall mount 2910 is coupled to the wall. The wall mount connection 2905 can connect with the wall mount 2910 in any number of different ways.

In some instances, the wall mount 2910, as shown, has a protruding arm that extends outwardly from the wall. The arm includes a recessed or dipped portion, which is designed to accommodate the wall mount connection 2905. When the wall mount connection 2905 is disposed within the recessed portion of the arm, the exercise machine is secured in place.

Optionally, other connection techniques may be used. Examples include, but are not limited to, bolts, screws, clasps, latches, and so forth. Indeed, any type of connection mechanism may be used to secure the frame 2900 to the wall mount 2910.

In the illustration shown in FIG. 29, the wall mount connection 2905 is on the outer perimeter region of the frame 2900. In some embodiments, the wall mount connection 2905 may be located on the inner side of the frame 2900. That is, the frame 2900 is shown as having a hollow rectangular shape. In FIG. 29, the wall mount connection 2905 is on the outer perimeter of the hollow rectangle. In some embodiments, the wall mount connection 2905 may be on the inner perimeter of the hollow rectangle.

The wall mount connection 2905 may also be located on the top portion of the frame 2900 and/or on the bottom portion of the frame 2900. Any number of wall mount connections may be used. FIG. 29 shows another wall mount 2915 with a corresponding wall mount connection (not labeled in the figure). Indeed, the frame 2900 may include 1, 2, 3, 4, 5, 6, 7, 8, 9, 10 or more than 10 wall mount connections. In some cases, the various wall mount connections may be of the same type (e.g., perhaps a protruding member) while in other cases combinations of multiple different types of wall mount connections may be provided on the frame 2900. Accordingly, the frame 2900 includes one or more connections for mounting the exercise machine to a wall. Some embodiments use hooks to hang the machine from the wall.

Some embodiments use a U-bracket to mount the exercise machine to the wall. The U-bracket may be as wide as the machine and can be used to support the machine against the wall. The U-bracket can be on the bottom of the machine or some other location. Some embodiments mount wheels on the bottom of the machine to help the machine be easily moveable. Typically, the machine is lifted about 3 inches off of the ground because, in some embodiments, pulleys are provided on the bottom portion of the machine.

Because the disclosed embodiments refrain from using heavy metal weights to provide resistance, the weight of the entire unit is orders of magnitude lighter than the weight of traditional exercise machines. For example, in some cases, the weight of the entire unit is 20 pounds, 25 pounds, 30 pounds, 35 pounds, 40 pounds, 45 pounds, 50 pounds, 55 pounds, 60 pounds, 65 pounds, 70 pounds, 75 pounds, 80 pounds, 85 pounds, 90 pounds, 95 pounds, or less than 100 pounds. The weight may be anywhere in between 20 pounds and 100 pounds.

Despite the weight being between only 20 to 100 pounds, the exercise machine is able to provide resistive force spanning between 1 pound and over 200 pounds. In some cases, the provided resistive force may be between 1 pound and 300 pounds. Using the selection unit as well as the ability to swap out different types of elastomeric bodies, the unit is also highly customizable and can provide drastically varying levels of resistance, which customizability is not achievable using traditional systems. Accordingly, in some embodiments, the frame includes connections for mounting the exercise machine to a wall, and a weight of the exercise machine is less than 60 pounds. In some implementations, the selectively variable elastic resistance is equivalent to more than a 250 pound gravimetric weight. Due to the use of elastomeric bodies, as the pulling force applied to the connected handle increases, the selectively variable elastic resistance increases such that the selectively variable elastic resistance does not remain constant during movement of the arc plates.

The present invention may be embodied in other specific forms without departing from its characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An exercise machine for muscle development and therapy, said exercise machine comprising:

a frame;

a pulley assembly supported by the frame;

a cable extending through the pulley assembly, the cable having attachments at its opposite ends, including an attachment for connecting to a pull handle, the cable also being connected to a selectively variable moveable resistance unit; and the selectively variable moveable resistance unit, which is structured to provide a selectively variable elastic resistance when a pulling force is applied to the connected pull handle and which is connected to the cable, wherein the selectively variable moveable resistance unit comprises:

a first elastomeric body;

a first arc plate that provides a first curved support member on which a portion of the first elastomeric body at least partially wraps around;

a second elastomeric body;

a second arc plate that provides a second curved support member on which a portion of the second elastomeric body at least partially wraps around;

a selection unit for enabling different selection settings of the selectively variable moveable resistance unit, wherein the different selection settings causes the first elastomeric body or a combination of at least the first elastomeric body and the second elastomeric body to provide the selectively variable elastic resistance, and wherein:

movement of the first arc plate or the first and second arc plates, which movement is caused by the pulling force applied to the pull handle, causes the first elastomeric body or the first and second elastomeric bodies to stretch and to provide the elastic resistance, and the second arc plate is nested within the first arc plate.

2. The exercise machine of claim 1, wherein the selectively variable elastic resistance dynamically increases based on a stretch amount of the first elastomeric body and/or the second elastomeric body.

3. The exercise machine of claim 1, wherein an outermost circumference of the second arc plate is within a minimum threshold value of an innermost circumference of the first arc plate to enable the second arc plate to be nested within the first arc plate.

4. The exercise machine of claim 1, wherein the selectively variable moveable resistance unit includes at least five elastomeric bodies, including the first elastomeric body and the second elastomeric body, and includes at least five arc plates, including the first arc plate and the second arc plate.

5. An exercise machine for muscle development and therapy, said exercise machine comprising:

a frame;

one or more guide rails that are connected to the frame and that are structured to guide connected members along a movement direction;

a height adjustment rail that is connected to the frame and that runs parallel to the one or more guide rails;

a pulley assembly that is supported by the frame and that includes at least one pulley, wherein the at least one pulley is connected to the height adjustment rail, the at least one pulley being moveable along the height adjustment rail to accommodate different heights of different exercise movements;

a cable extending through the pulley assembly, the cable having attachments at its opposite ends, including an attachment for connecting to a pull handle, the cable being connected to a selectively variable moveable resistance unit; and the selectively variable moveable resistance unit, which is operatively connected with the one or more guide rails and which is guided in the movement direction by the one or more guide rails when operated, the selectively variable moveable resistance unit being structured to provide a selectively variable elastic resistance when a pulling force is applied to the connected pull handle and being connected to the cable, wherein the selectively variable moveable resistance unit comprises:

a plurality of elastomeric bodies that provide the selectively variable elastic resistance when the pulling force is applied to the pull handle, wherein different selection settings of the selectively variable moveable resistance unit causes one or a combination of multiple elastomeric bodies to be engaged to provide the selectively variable elastic resistance; and a plurality of nested arc plates, wherein each nested arc plate provides a curved support member on which a portion of a corresponding elastomeric body at least partially wraps around, and wherein the different selection settings of the selectively variable moveable resistance unit causes one or a combination of multiple nested arc plates to be engaged, and wherein movement of whichever ones of the nested arc plates are engaged causes corresponding elastomeric bodies of whichever ones of the nested arc plates that are engaged to stretch and to provide the selectively variable elastic resistance.

6. The exercise machine of claim 5, wherein the frame includes connections for mounting the exercise machine to a wall, and wherein a weight of the exercise machine is less than 40 pounds.

7. The exercise machine of claim 5, wherein a weight of the exercise machine is less than 40 pounds, and wherein the selectively variable elastic resistance is equivalent to more than a 250 pound gravimetric weight.

8. The exercise machine of claim 5, wherein, as the pulling force applied to the connected pull handle increases, the selectively variable elastic resistance increases such that the selectively variable elastic resistance does not remain constant during said movement.

9. The exercise machine of claim 5, wherein the pulley assembly includes at least four pulleys.

* * * * *